US006142300A

United States Patent [19]

Kelly et al.

[11] Patent Number: 6,142,300

[45] Date of Patent: Nov. 7, 2000

[54] BOTTLED WATER SHIPPING RACK

[75] Inventors: Daniel Kelly, 9 Roxbury Dr., Medford, N.J. 08055; Emerson B. Donnell, Jr., Basking Ridge, N.J.

[73] Assignee: Daniel Kelly, Medford, N.J.

[21] Appl. No.: 09/459,014

[22] Filed: Dec. 10, 1999

Related U.S. Application Data

[63] Continuation-in-part of application No. 09/215,692, Dec. 18, 1998, Pat. No. 6,026,958.

[51] Int. Cl.[7] ..... B65D 21/00

[52] U.S. Cl. ..... 206/503; 206/3; 206/372

[58] Field of Search ..... 220/23.6, 507, 220/512, 513; 206/3, 372, 503

[56] References Cited

U.S. PATENT DOCUMENTS

| | | |
|---|---|---|
| 3,802,595 | 4/1974 | Frahm et al. . |
| 3,870,155 | 3/1975 | Galloway . |
| 3,998,328 | 12/1976 | Box . |
| 4,093,076 | 6/1978 | Newton . |
| 4,095,698 | 6/1978 | Wright . |
| 4,099,626 | 7/1978 | Magnussen, Jr. . |
| 4,143,784 | 3/1979 | Frahm et al. . |
| 4,343,400 | 8/1982 | Faucillon . |
| 4,366,641 | 1/1983 | Price et al. . |
| 4,485,930 | 12/1984 | Savelkouls . |
| 4,506,796 | 3/1985 | Thompson . |
| 4,520,941 | 6/1985 | Hagan et al. . |
| 4,566,588 | 1/1986 | Kataczynski . |
| 4,655,668 | 4/1987 | Perisastry et al. . |
| 4,733,773 | 3/1988 | LaBianca . |
| 4,799,592 | 1/1989 | Hessmert . |
| 4,911,303 | 3/1990 | Andersson . |
| 4,942,967 | 7/1990 | Schneider . |
| 5,097,980 | 3/1992 | Warwick . |
| 5,228,569 | 7/1993 | House . |
| 5,261,208 | 11/1993 | Lockhart . |
| 5,370,245 | 12/1994 | Terach et al. . |
| 5,503,275 | 4/1996 | Fesquet . |
| 5,704,482 | 1/1998 | Apps et al. . |
| 6,026,958 | 2/2000 | Kelly et al. ..... 206/503 |

*Primary Examiner*—Steven Pollard
*Attorney, Agent, or Firm*—Ratner & Prestia

[57] ABSTRACT

A stackable crate and modular rack system for horizontally retaining large bottles such as used in the bottled water industry. The individual crates may be adapted to retain multiple bottles held in various configurations. The individual crates may be formed of multiple components. The crates are designed to provide stability when stacked on top of one another to form a modular rack system. The individual crates include an alignment feature, and a locking feature which also provides for sliding one stacked crate over another.

28 Claims, 28 Drawing Sheets

BOTTLED WATER SHIPPING RACK

RELATED APPLICATION

This application is a Continuation-in-part of application Ser. No. 09/215,692, filed on Dec. 18, 1998, now U.S. Pat. No. 6,026,958.

FIELD OF THE INVENTION

This invention relates in general to rack systems for supporting large bottles used in the bottled water industry and, more particularly, to a modular rack system for containing and supporting such bottles.

BACKGROUND OF THE INVENTION

Two known devices are commonly used for supporting large bottles, such as a five gallon water bottle, a three gallon square water bottle, or a three gallon round water bottle, typically used in the drinking water industry. These two devices are a crate and a metal rack.

A crate is essentially a square wooden or molded plastic container adapted to contain one bottle. Crates are adapted to be stacked upon one another to allow transport and handling of a plurality of bottles. To stabilize a stack of crates, however, the stack must be wrapped with shrink-wrap plastic.

After transport of the stacked crates, in, for example, a delivery van, a worker must individually lift and unload each of the full crates to remove the bottles for delivery. This adds significant labor time and provides a higher risk for injury, especially wrist and back injuries, and injuries from falling crates. During transport, crates expose the bottle caps allowing caps to hit other crates which causes leaking.

Most crate systems transport the bottle in the crate into the clean filler room. This contaminates the clean room, as simple crate washers cannot fully remove all contaminants. The additional weight of the crates causes additional wear and tear on transport equipment.

Metal racks are fixed in size and shape. After unloading the bottles from a delivery or transport truck using metal racks, the truck must return with the empty bottles held by the same metal rack that was used to deliver the bottles. The metal rack cannot be collapsed or rearranged to a more efficient shape. This means that the same number of vehicles must be used to transport racks full of empty bottles as racks of full bottles between the source and the distributor.

In addition, metal rusts and tends to rapidly corrode when exposed to the ozone used in many water purification processes, and the metal racks, which are fixed in size and shape, can cause damage to the interior walls and flooring of a transport or delivery vehicle

SUMMARY OF THE INVENTION

The present invention is embodied in a stackable crate, comprising a top portion defining an upper plane having four corners, a bottom portion defining a lower plane having four corners, two opposite end portions forming a front and a rear, a distance between the front and rear defining a length, and two opposite side portions. The stackable crate includes at least one hollow-retaining member for holding a plurality of bottles. The retaining member includes an inner boundary defined by edges of a plurality of supporting beams. The beams extend to top portion or the bottom portion to provide support. The boundary may be a discontinuous surface or a solid retaining wall. A front opening is formed on the front of the crate for loading and unloading bottles. A vertical plane extends generally from the front to the back and includes a plurality of vertical support ribs protruding inwardly from and extending along the vertical plane to provide strength points. The retaining member is positioned to retain the plurality of bottles in a horizontal orientation and along a common axis.

The present invention includes an alignment system with alignment ribs extending diagonally inward from the corners of the crate, both on the top and bottom of the crate.

The present invention also includes a locking mechanism to lock the units into place on top of one another. The locking mechanism includes projections from the top of a unit which fit into a cavity formed in the bottom of a unit stacked on top, or vice versa. The present invention also includes a sliding mechanism, which allows one stacked unit to slide laterally or longitudinally over the upward projections which form the locking mechanism of a subjacent unit.

DETAILED DESCRIPTION

The present invention is embodied in a plastic modular rack having a plurality of stackable individual units that may hold one, two, three, four, or other numbers of bottles in a number of configurations. One example of unit construction holds four bottles, two wide and two deep. The units are stackable and are designed to provide mechanical stability when stacked as high as ten units. The racks are modular and may be custom fit to any number of bottles wide or high, for example, five bottles high as is the industry standard.

The present invention provides for better utilization of space in storage or transport systems, as the number of racks stacked may be varied. For example, in a delivery truck where stacks of 5 units high may be the standard, a shortened stack of 3 units high may be used over the wheelwell.

This invention provides significant improvements over one additionally known stackable plastic tray product (such as the Aqua-Caddie available from Jeco Plastic Products of Plainfield, Ind.). The Aqua-Caddie has four contact points for mating the stackable trays. Its disadvantages include that it is too big and heavy for easy manual loading, requiring a forklift to be used. The forklift may damage the bottles because of the lack of clearance between the top of the retained bottle and the lifting surface. The height of each unit is considerably greater than that of the bottles they retain, so that stacking the units is not an efficient use of vertical space. Additionally, the trays cannot easily slide over one another and it is difficult to use this product with the automated equipment that is typically used in the bottled water industry. The Aqua-Caddie is typically blow-molded or rotation molded, methods which use open cavity molds that preclude the addition of openings through solid features to serve as drainage features.

This invention provides significant improvements in safety and ergonomics. The units are designed to slide over and off one another, rather than having to be lifted, thereby helping to prevent injury to users due to lifting—a bottle and crate typically weighs 50 pounds. The units may also be slid laterally over one another to lock into position.

Because they may be two bottles wide, the stacks are also more stable than the crate stacks, and do not require the use of shrink-wrap to enhance stability. The units may be made to snap together to enhance stability. The interlocks and wide footprint also enhance stability, and thus the safety of the stack. The individual units can be pulled off by means of the sliding mechanism and stacked on a dolly, thereby promoting ease of handling.

Alternatively, a number of individual units may be fastened together to form a larger rack system, which can be easily disassembled or reconfigured, and therefore offers an advantage over a fixed metal rack system. Metal or other strapping means may be used to fasten the stacked units together. The molding may include bosses, or openings through which a metal rod may be inserted to secure the units together. Alternatively, fastening means which temporarily secure the units together, during transport for example, may be used.

The present invention offers the advantage of flexibility as to method of production, and material of construction. Each unit may be molded in one integral piece or in two or more pieces adapted to snap or otherwise be fastened together. Any kind of molding procedure is suitable for this fabrication. The molding may be done from the top or from the side. The unit may be molded, for example, using structural foam. It may be molded using injection-molding techniques such as gas assisted injection molding or reaction injection molding. Alternatively, it may be molded using compression molding, structural web molding or vacuum forming. The preferred material of construction may be polyethylene, but polypropylene or resins including engineering resins may be used. Additionally, the present invention may be rotationally molded, or blow molded, although embodiments molded using these methods would lack some of the features described hereinafter.

Another advantage associated with the method of construction of the present invention is the relative ease of maintaining a set of tight dimensional tolerances in the manufacture of a plastic modular rack unit. In comparison, it is much more difficult to manufacture a metal rack system to the same set of tolerances. With the units of the modular rack system manufactured to a tighter set of tolerances, the automated equipment used in stacking the units, and in loading, and unloading bottles, runs more efficiently.

Alternatively, each unit may be molded in two equal pieces which lock together, and which utilize the alignment feature to secure the units into position. According to another exemplary embodiment, each unit may be formed of two unequal pieces which are joined together to form the unit. According to yet another exemplary embodiment, each unit may be formed of a number of separately molded pieces which are joined together to form a unit.

Each unit may be made to house two or more bottles and the completed, stacked unit may be of any suitable width, height, and depth. Typically, the bottled water industry uses stacks of four bottles wide, five bottles high, and two bottles deep. Stacks of three bottles wide, five bottles high, and two bottles deep are also used. The modular units of this invention may be made to comport with any of these or other desired dimensions.

For the 4×5×2 construction commonly used in the bottled water industry, two 2×2 units, each holding four bottles, may be used side by side and then stacked five high, one upon the other. Each 2×2 unit may include two hollow retaining members, side by side, whereby each retaining member is sized to hold two bottles held along a common axis. In two exemplary embodiments, the bottles may be standard 3 gallon or 5 gallon round bottles as used in the bottled drinking water industry. To retain and allow for easy insertion and removal of 5 gallon bottles commonly used in the bottled water industry, a cylinder with a diameter of 10.95 inches may be used to retain the bottles. For 3×5×2 construction, each unit can be three bottles wide and two bottles deep and adapted to be stacked five high. The units are desirably configured to fit on industry standard pallets. Ideally, a 40"×48" or 36"×40" footprint is desirable to allow the units to be loaded and stacked onto industry standard pallets inserted and transported in a delivery or transport truck. Alternatively, a single 2×2 unit may be stacked upon a 24"×40" pallet which is also commercially available.

Yet another advantage of the modular rack system is that the use of plastic pallets with the modular rack will reduce production line downtime caused by splintered pallets or crates, and help maintain the clean environment necessary in the bottling plant.

According to another exemplary embodiment, the units may include legs and will not require the plastic pallets. The legs provide sufficient clearance to allow a forklift to slide under a unit placed on the ground. The legs may alternatively be received within corresponding recessed regions formed in the top of a subjacent unit, thereby providing an alignment feature for stacking the crates.

According to the exemplary embodiment for holding 3 gallon bottles, various configurations, such as a 2×2 unit, a 3×2 unit, a 2×3 unit, a 4×2 unit, and a 2×4 unit are contemplated. The dimensions and footprints of the smaller units sized to accommodate 3 gallon bottles, will vary accordingly.

Ergonomically, the empty crates may be easily arranged, reconfigured, and restacked to maximize space usage in delivery or transport vehicles. In this manner, less floor area is used transporting empty racks than full ones, thereby requiring fewer vehicles and related expenses in transporting empty racks from the distributor to the source.

The plastic modular rack was conceived with the primary objective to combine the positive factors of both plastic crates and metal racks into a system superior to both.

The stability of the modular rack allows current crate users to eliminate the need to stretch wrap outgoing loads, which eliminates the considerable expenses associated with the equipment, labor and materials required by the stretch wrapping process. In addition, the labor required to stack 16 crates, for example, and then stretch wrap them is reduced to simply stacking four plastic modules. This may be done even faster with the aid of an available forklift/lateral clamp attachment.

By allowing full access to all the bottles on the truck, the modular rack eliminates the need to individually unload each crate, therefore reducing bottle-unloading time by an average of 30 percent per stop. The crate user enjoys the identical return payload benefit of crates, as the plastic modular rack may be stacked seven high for the return trip to the bottling plant.

The bottles may be easily unloaded from the units by use of automated unloading equipment. The time associated with removing the shrink wrap, is eliminated. Without the crates, the bottles are transported into the clean room by themselves, which reduces filler room contamination. This also allows for a smaller filler to be used, and reduces the wear and tear on conveyors and drive motors.

Metal rack users, if they switch to modular racks according to the present invention, are able to utilize all available space on return transport, providing freight savings of up to 30 percent. Ongoing labor expenses for repair of metal racks are also avoided using the present invention. This eliminates downtime in automated equipment from deformed metal racks. Plastic racks require less ongoing repair time. The racks or pallets, if damaged, can be removed, quickly replaced and the system immediately returned to service. The damaged part can then be easily recycled.

The price of the modular rack may be comparable to that for metal racks. The weight of plastic racks may be less, saving on fuel and allowing a higher outgoing payload on transports. Plastic racks will not damage the flooring or interior walls of the delivery or transport vehicle. Transport space will be more fully utilized, as the modular racks can be stacked very high (for example 7 as typical in the industry for return loads) increasing payload in transports by up to 30%.

The plastic modular rack system also enhances plant appearance. Plastic does not rust as does metal. Unsightly rusting metal racks, scraps of stretch wrap, and the wood pallets used for stacking stretch wrapped crates, are eliminated. The racks rarely leave the delivery vehicle, except when returned to the plant or distribution center, and are less attractive for uses outside the bottling industry. Thus, losses due to theft are reduced.

The plastic modular rack provides major reductions in both production and distribution costs as well as labor saving compared to the crate or metal rack users. In the plant, the present Plastic Modular rack system invention offers the following advantages over crates. Crates require both a depalletizer at the start of the line and a palletizer at the end of the production line. If either machine fails, production cannot continue. The modular rack requires only a single stacker/unstacker. Racks will be completely stacked at the beginning of the production line, as received with empty bottles. In the event that the stacker/unstacker malfunctions, the racks may be manually staged and loaded on the production line, allowing production to continue.

The present invention can be best understood through a detailed description of an exemplary embodiment depicted in the following drawings.

DETAILED DESCRIPTION OF THE DRAWINGS i. First Exemplary Embodiment of a Stackable Unit

Figure 1:
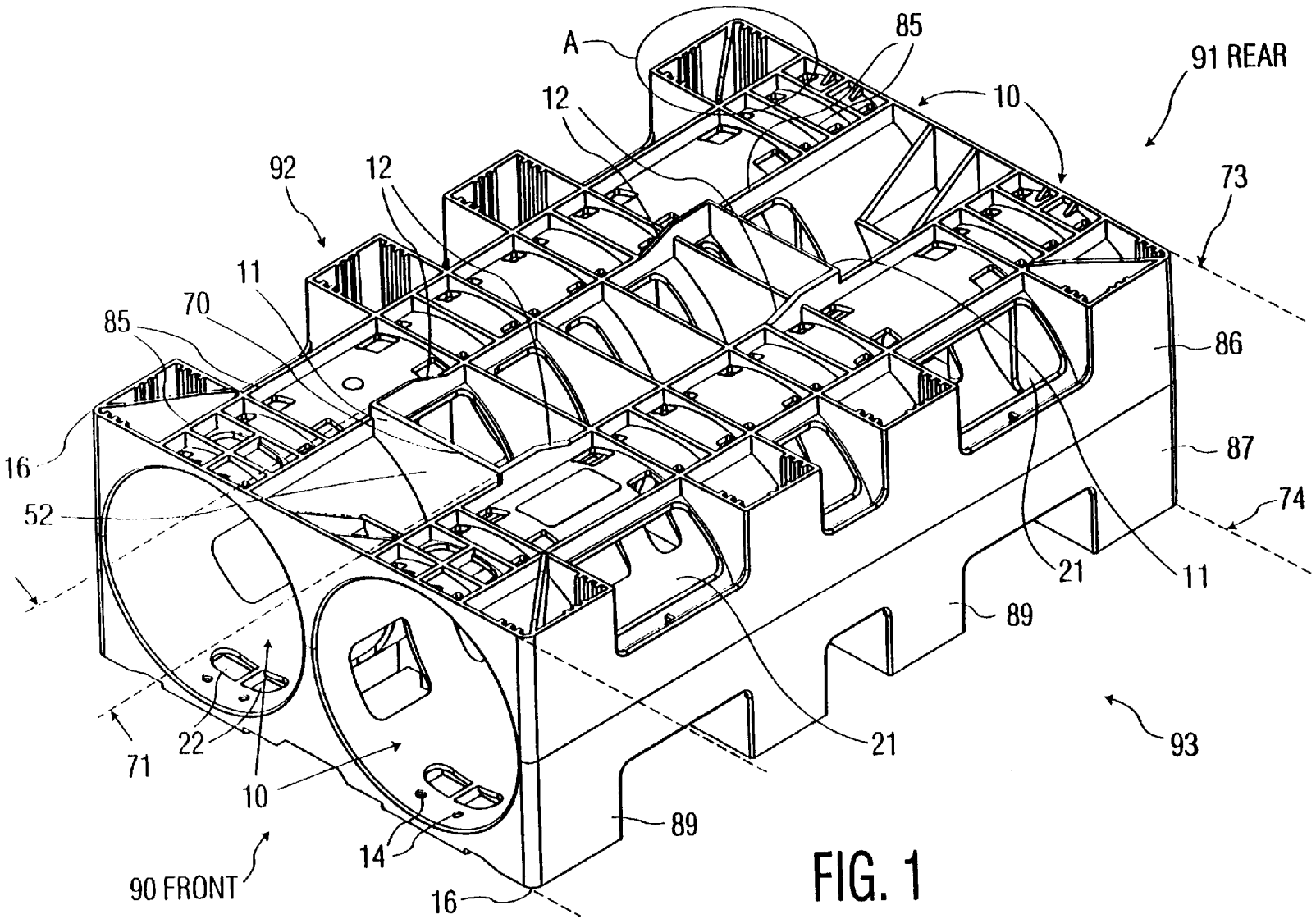
FIG. 1 illustrates a first exemplary embodiment of a single unit in the rack system of this invention.

FIG. 1 illustrates a first exemplary embodiment of a single unit in the rack system of this invention. This unit is adapted to hold four bottles, two wide and two deep. The bottles are contained in hollow retaining members 10. In the first exemplary embodiment illustrated in FIG. 1, the hollow retaining members comprise cylinders. The crate consists of an upper portion 86 and a lower portion 87. A peripheral wall 89 extends around the periphery of the crate. The crate includes a front 90 and a rear 91, and two opposed sides 92 and 93.

Figure 2:
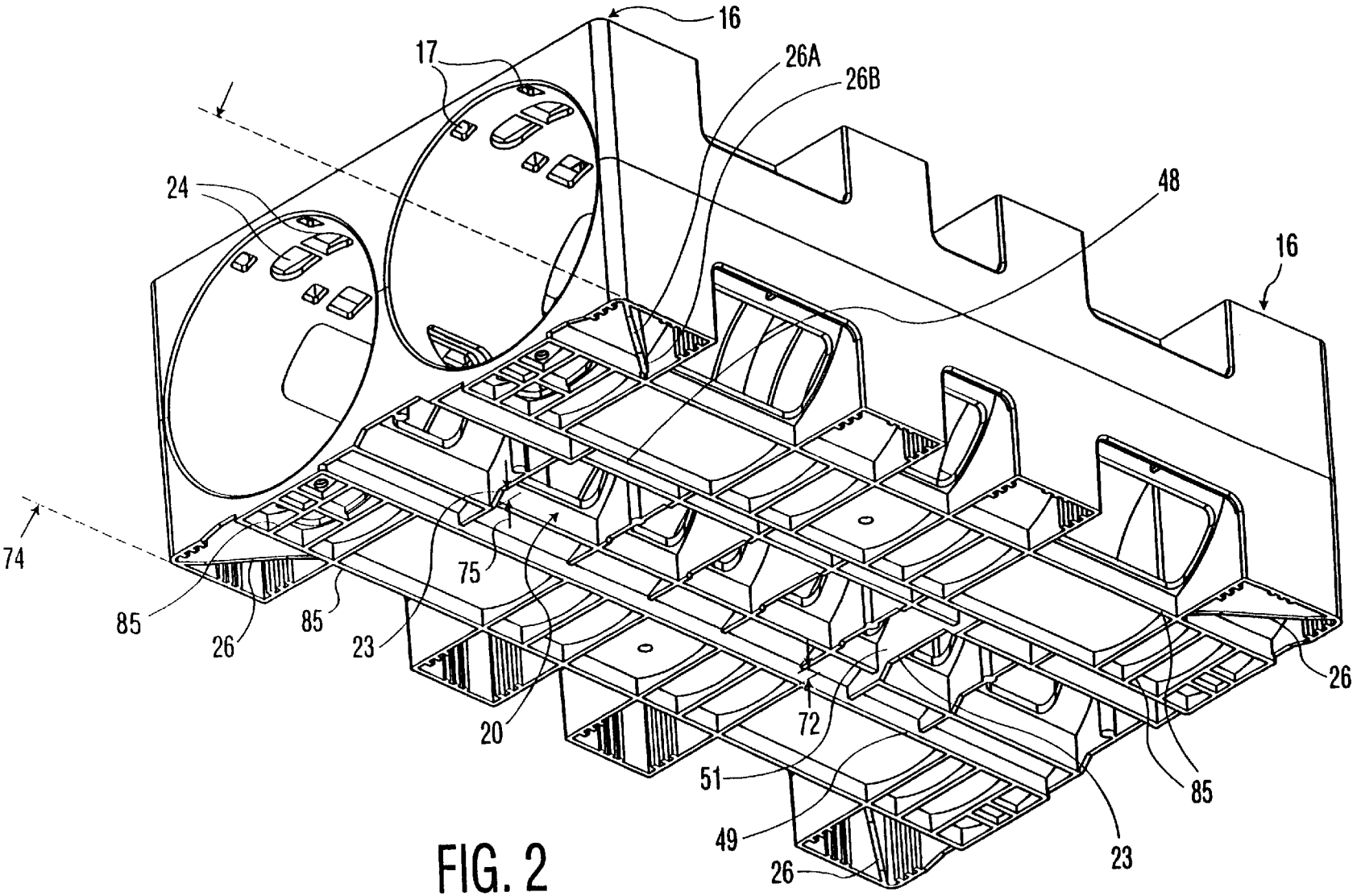
FIG. 2 is a perspective view showing the bottom of the unit according to the first exemplary embodiment.

The top of the crate unit defines an upper plane 73 and the bottom of the unit defines a lower plane 74. The top and bottom each have four corners 16. The top of the unit has raised portions 11 which include an upper rib 70 and ramps 12. The upper rib 70 is defined by a length 71, and includes an outer surface 52. This raised portion allows a unit stacked on top of the illustrated unit to lock into place and also allows for the upper stacked unit to slide on and off, into and out of position. The ramps 12 allow for a corresponding locking feature on the bottom of a unit (as depicted in FIG. 2) to slide over the rib 70 and lock into place over raised portion 11. In an alternative embodiment, ramps 12 may take on a slightly different configuration (as described in conjunction with FIG. 3), but still provide the sliding feature as above. Support beams 85 extend from the hollow retaining member 10 to the upper plane 73 to provide support for a unit stacked on top. In a preferred embodiment, bosses (not pictured) may project from support beams 85 to form a stacking feature.

Openings 14 may be provided in each of the hollow retaining members 10 through which bumper pins (not shown) may be inserted to help hold the bottles in place. The bumper pins may be made of a polypropylene fleximer (or other suitable material) with a higher coefficient of friction than the material from which each unit is made. In the exemplary embodiment shown, each hollow-retaining member is sized to retain two bottles positioned front-to-rear. According to this exemplary embodiment, in addition to the pair of openings 14 located adjacent the front opening as shown, another pair of openings (not shown) may be located for securing a rear position of the front bottle, and yet another pair of openings (not shown) may be located for securing the front portion of the rear bottle. Larger openings 22 may be provided to allow for drainage and to form handles which may be used to move the modular racks. Windows 21 allow for the viewing of the bottles retained within the crate and reduce the weight of the crate.

Figure 1A:
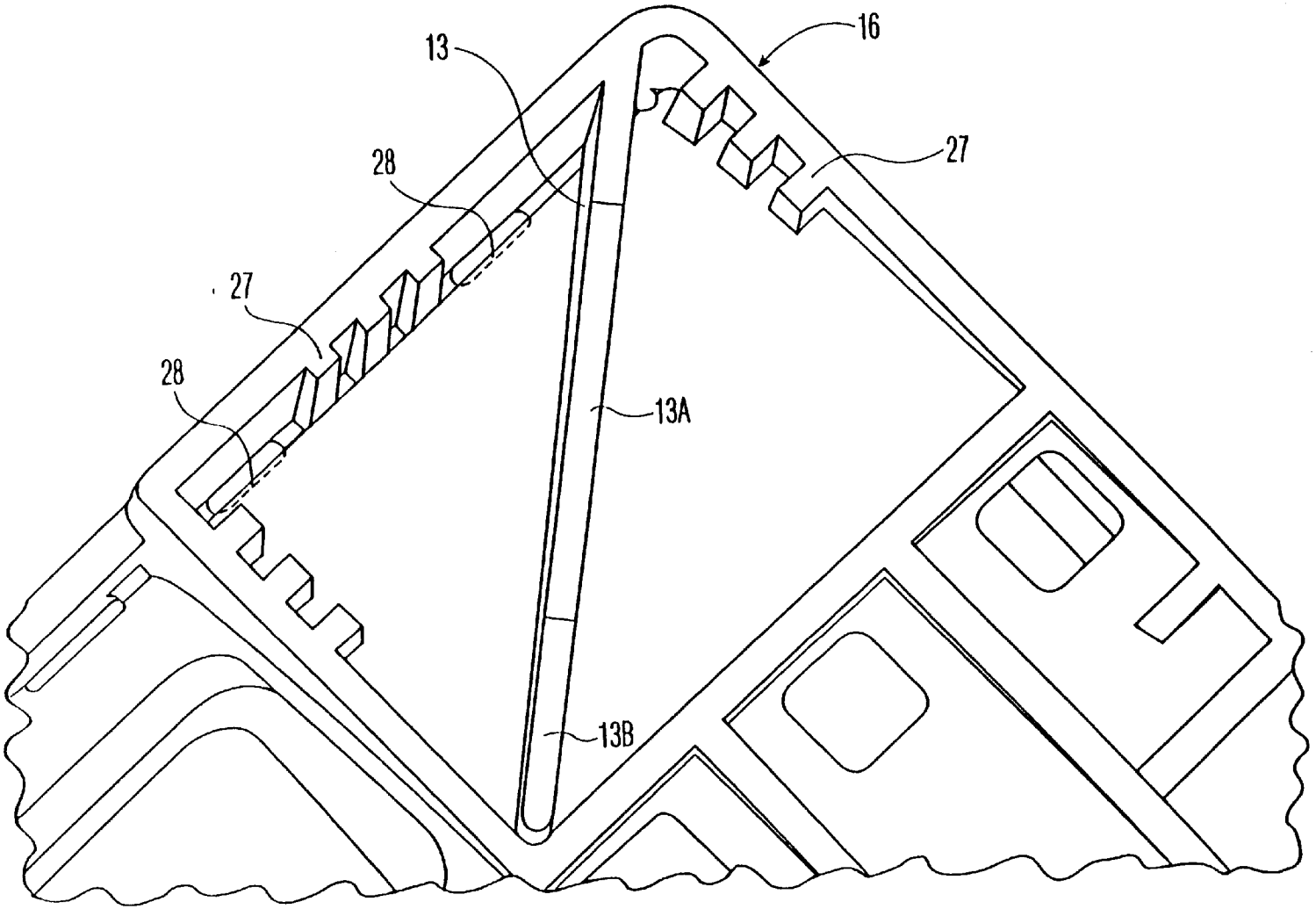
FIG. 1A is a perspective view of a corner depicting the upper alignment feature of the invention.

The circled portion A of FIG. 1 is illustrated in more detail in FIG. 1A. In an exemplary embodiment shown in FIG. 1A, the corners 16 on the top portion of each unit may include a sloped, raised alignment rib 13 which allows alignment with a mating rib of the corresponding lower section of a stacked unit. In addition, the alignment rib 13 allows locking of the mating portion, and facilitates the sliding feature by which allows empty units to be easily removed from a stack, as described above. Ribs 13 are flat and level with the upper surface of the unit at their outer ends, then slope upward (13A) and level off (13B) at a height above that of the upper section of the unit, at their inside edges. The ribs 13 provide strength points and assist in locking the stacked units into place. In other exemplary embodiments, the alignment rib 13 may be substantially flat and co-planar with upper plane 73. Vertical ribs 27 which line the inner vertical walls, provide additional contact/strength points and prevent jamming of a crate with a crate stacked above or below it. Drainage slits 28 may also be used to connect stacked units together through the use of a strapping means.

Typically, the bottled water industry uses stacks of four bottles wide, five bottles high, and two bottles deep. The modular units of this invention may be made to comport with these or other desired configurations. For example, with the 4×5×2 construction, two 2×2 units, as shown in FIG. 1, may be used side by side and then stacked five high, one upon the other.

FIG. 2 is a perspective view showing the bottom of the first exemplary embodiment depicted in FIG. 1. Support beams 85 extend from the hollow retaining member 10 to the lower plane 74 to provide support for the hollow-retaining member.

The bottom of the unit has a recessed longitudinal cavity 20 and a locking rib 23 at either end of the recessed longitudinal cavity. Longitudinal ribs 48 and 49 form the sides of recessed longitudinal cavity 20 and extend along the lower plane 74. The locking rib 23 has an inner surface 51. The depth 72 of the cavity is the distance between the lowermost feature within the cavity and the lower plane 74. The depth of indentation 75 represents the distance between the locking rib 23 and the lower plane 74, and is less than the cavity depth 72. The locking ribs 23 are adapted to interlock with raised portions 11 (shown in FIG. 1) of a unit onto which the unit in FIG. 2 is mounted, or alternatively a locking feature mounted on a pallet. Once the locking rib 23 clears the corresponding raised portion 11 of a subjacent crate, the raised portion 11 becomes nested within the longitudinal cavity 20 so that the outer surface 52 of the raised portion 11 is in close proximity to the inner surface 51 of the locking rib so as to lock the units into position. The is surfaces 51 and 52 may be incidentally in contact with one another, but do not form a tight fit so as to jam the units together and to prevent unstacking.

For the sliding mechanism, once the locking rib 23 clears the corresponding raised portion 11, the recessed longitudinal cavity 20 provides the slide-off feature wherein each unit can slide easily with respect a stacked unit because of the graduated grooves within the recessed longitudinal cavities. The ramps 12 allow the locking rib 23 to slide easily over the opposite raised portion 11. The sliding feature works in either direction, so that racks may slide either forward or backwards. The stacking of the units is also referred to as "rendering" in the art.

In an alternative embodiment, the central sliding and interlocking feature (the raised portions 11 and corresponding locking ribs 23) may be asymmetrical to prevent misstacking of racks.

The bottom of the may unit also contain recessed alignment ribs 26 to cooperate with the raised alignment ribs 13 of a subjacent crate as shown in FIG. 1A. Recessed alignment ribs 26 are flat and level with the lower surface of the unit at their outer ends, then slope upwards 26A and level off at a level above that of the bottom surface of the unit, providing an indentation portion 26B which corresponds to the raised portion of alignment rib 13 on the top of a unit to facilitate alignment upon stacking, and also to prevent jamming of one stacked crate into another in conjunction with the vertical ribs.

In an alternative embodiment, the upper plane of the top of the unit may contain the recessed alignment ribs (26 in FIG. 2) with the bottom containing the raised alignment ribs (13 in FIG. 1A). In another alternative embodiment, the top of the unit may contain both raised and recessed alignment ribs, with the corresponding corner of the bottom of the unit containing the other of the two alignment ribs, so that, in each corner, a raised rib mates with a recessed rib to align the stacked units into place. In another alternative embodiment, less than four alignment ribs may be used. As few as one alignment rib, in conjunction with the locking feature, may be used to align the stacked units. It is seen that the alignment ribs can be used interchangeably, provided corresponding top and bottom corners use opposed ribs to align the stacked units.

In yet another alternative embodiment, the alignment ribs are not included. In place of the set of cooperating raised and recessed alignment ribs, the corners of the units may alternatively include a diagonal, flat rib which is coplanar with its associated plane. These ribs (not shown) are substantially similar to upper alignment rib 13 as in FIG. 1A, but are coplanar with the upper plane and do not contain a raised section above the plane. These ribs serve as strength points for the stacked units and prevent jamming of stacked units.

Each unit preferably has sixteen strength points. Less material may be used in the construction of the units to make them light in weight, if so desired. The corners 16 of the unit include alignment ribs 13 and vertical ribs 27 which serve as strength points and prevent jamming. Therefore, if a unit is dropped, damage will be minimized, and the corners will not collapse.

Each unit may have holes 24 on the top of space 10 which serve as handles that facilitate loading and unloading. Holes 24 are sized to allow a finger to extend through so as to grasp the unit. Additional smaller openings 17 on the top of spaces 10 also provide for drainage.

Figure 3:
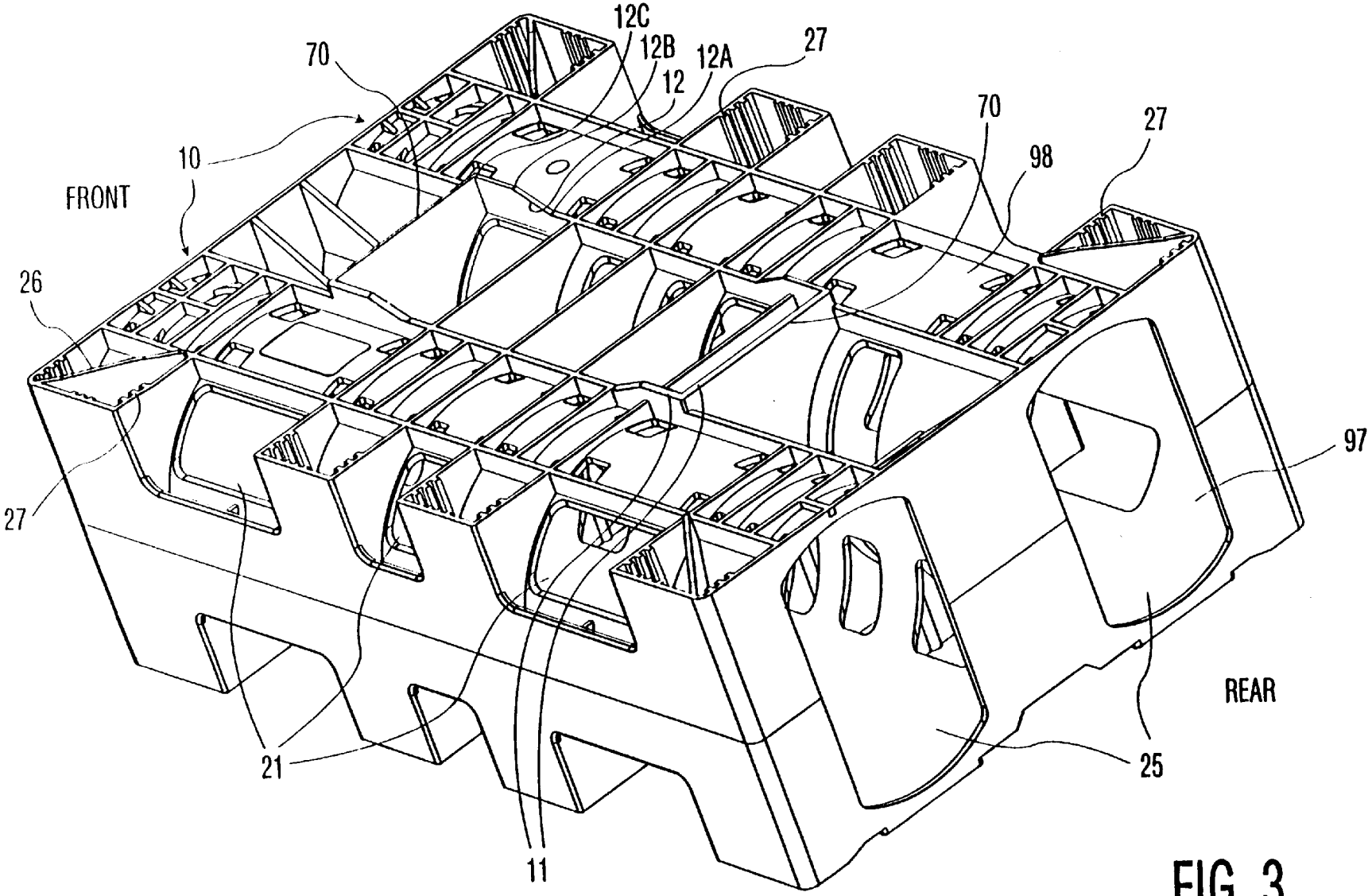
FIG. 3 is a perspective view from the top, rear of a unit according to the first exemplary embodiment.

FIG. 3 is a perspective view from the top, rear of the first exemplary embodiment depicted in FIG. 1 and FIG. 2. It can be seen that the hollow retaining members 10 consists of a wall having an inner surface 97 and outer surface 98. Windows 21 are provided in the unit for viewing the bottle. These windows allow easy visual determination of whether the bottles have a cap, and hence whether the bottles are full or empty. The rear openings 25 are provided and sized to allow debris to be forced out of the unit when bottles are inserted, and also to allow the bottles to be pushed from the rear manually or with automated equipment to facilitate unloading. The bottom section of retaining members 10 are flush with the bottom portion of rear openings 25 so that small objects will not be retained within the retaining members 10. The sides of rear openings 25 form barriers which will not allow bottles to pass through.

Ramps 12 provide for the sliding feature as discussed in conjunction with FIG. 1. In an alternative embodiment (not shown), the ramps may take on another configuration. In the alternative embodiment, junction 12B (shown in FIG. 3) is not included. Rather, ramp 12 includes a continuously sloped section extending from junction 12A to junction 12C in the alternative embodiment. The alternative embodiment still provides for the longitudinal sliding feature as discussed above, and also provides for a lateral stacking/sliding feature. A stackable unit, or a stack of units, may be grasped from the sides (opposed sides 92 and 93 as shown in FIG. 1) by the automated equipment typically used within the industry. The ramp 12 as described for the alternative embodiment, allows for an upper unit to slide laterally over a subjacent unit, and to lock into place.

When an upper unit is aligned to a subjacent unit, with respect to the front and rear of the units, it may be lowered onto the subjacent unit. If the upper unit is displaced laterally with respect to the lower unit, so long as longitudinal ribs 48 or 49 as shown in FIG. 2, contact upper rib 70 of the top of the subjacent crate, the units may be slid laterally with respect to one another. The units may be slid until upper rib 70 and raised portion 11 become nested within recessed longitudinal cavity 20, as described in conjunction with FIG. 2, to secure the units into place on top of one another. In another exemplary embodiment as will be shown in FIGS. 23 and 24 the units being stacked may be further displaced laterally with respect to one another upon initial placement, then slid laterally to lock into position using a lateral channel formed beneath the unit (not shown in FIG. 2).

Figure 4:
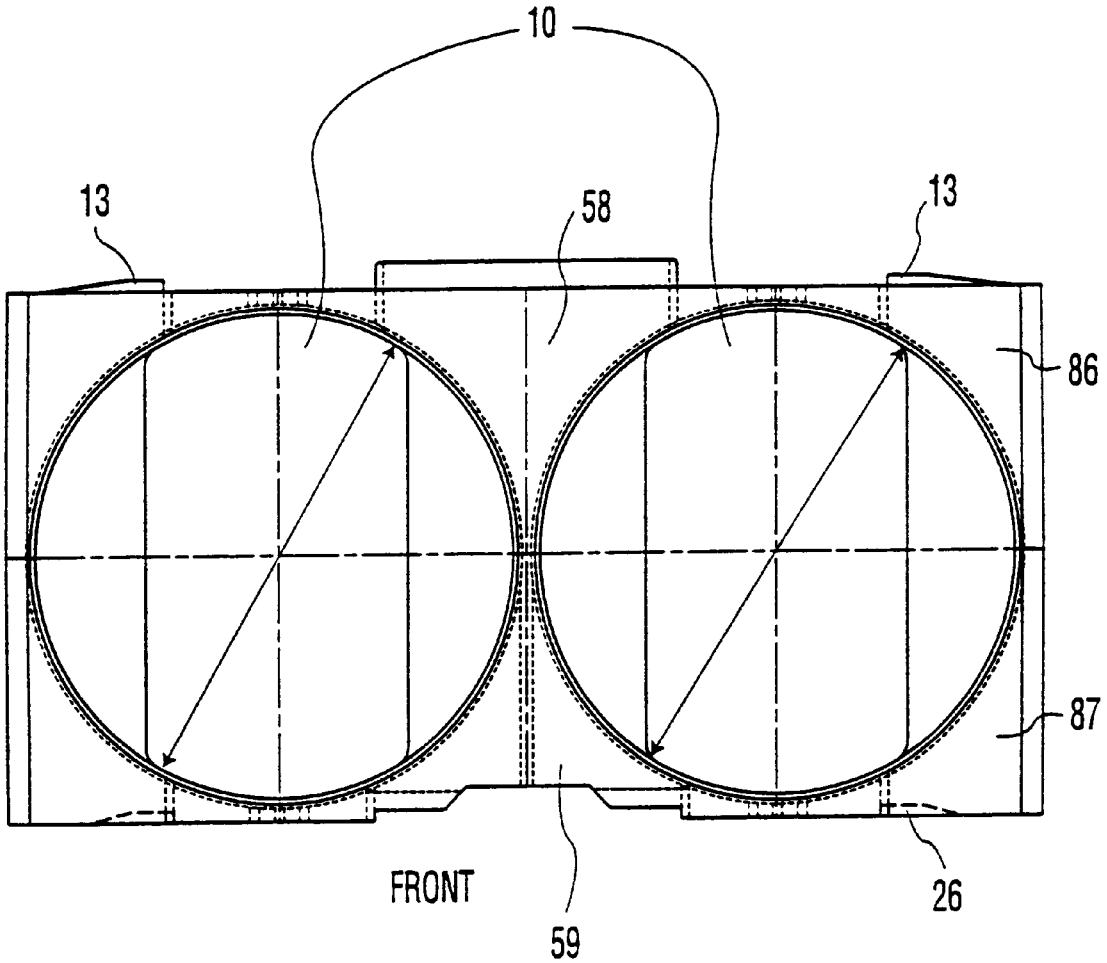
FIG. 4 is a front view of the exemplary unit according to the first exemplary embodiment.

FIG. 4 is a front view of the unit of the first exemplary embodiment showing the hollow retaining members 10 wherein the bottles are held. In this exemplary embodiment, the crates are sized to hold two bottles in each of two hollow retaining members 10. In an exemplary embodiment, the hollow retaining members 10 may be cylindrical and sized to retain standard sized 3 gallon bottles commonly used in the bottled water industry.

Other exemplary embodiments may be sized to hold differently sized bottles. According to another exemplary embodiment, the hollow retaining member 10, may be sized to retain standard 5 gallon bottles as commonly used in the bottled water industry. In this embodiment directed to retaining 5 gallon bottles, a diameter of approximately 11 inches may be used to retain the bottles, while also allowing for easy insertion and removal of the industry standard bottles. The exemplary diameter may be in the range of 10.95 to 11.25 inches. Other embodiments may be configured to retain more or less bottles per retaining member and also may include more or fewer retaining members.

In the exemplary embodiment shown in FIG. 4, the bottles may be positioned with the top, cap end facing forward for easy removal. The projections of alignment ribs 13 are also depicted, indicating where the ribs 13 project above the top surface of the unit, to align with corresponding mating rib 26 which form recesses from the lower side of the unit stacked on top. The locking features described with reference to FIGS. 1, 1A, and 2, are located within upper longitudinal compartment 58 and the lower longitudinal compartment 59 formed within the upper portion 86 and lower portion 87 of the unit respectively, between the laterally disposed retaining members 10.

Figure 5:
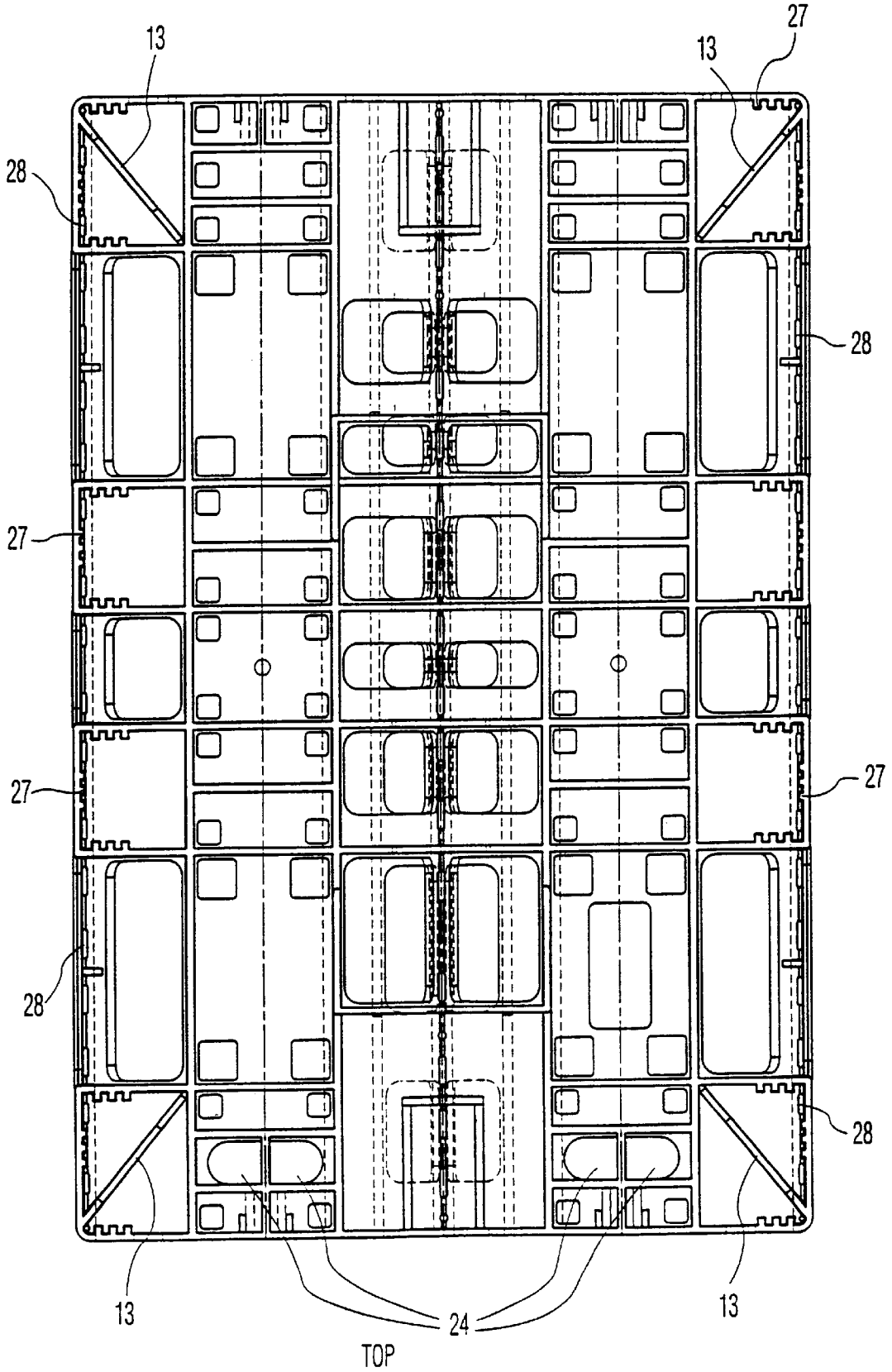
FIG. 5 is a top view of the exemplary unit according to the first exemplary embodiment.

FIG. 5 is a top view of the unit of the first exemplary embodiment. A plurality of vertical ribs 27 line the inner vertical walls to provide additional contact/strength points. Openings 24 positioned at the apex of the hollow retaining members 10 may provide for handles. Slits 28 are positioned along the sides of the unit to allow for drainage and may also provide for stacked units to be strapped together. Metal or other strapping means may be used to secure stacked units together.

Figure 6:
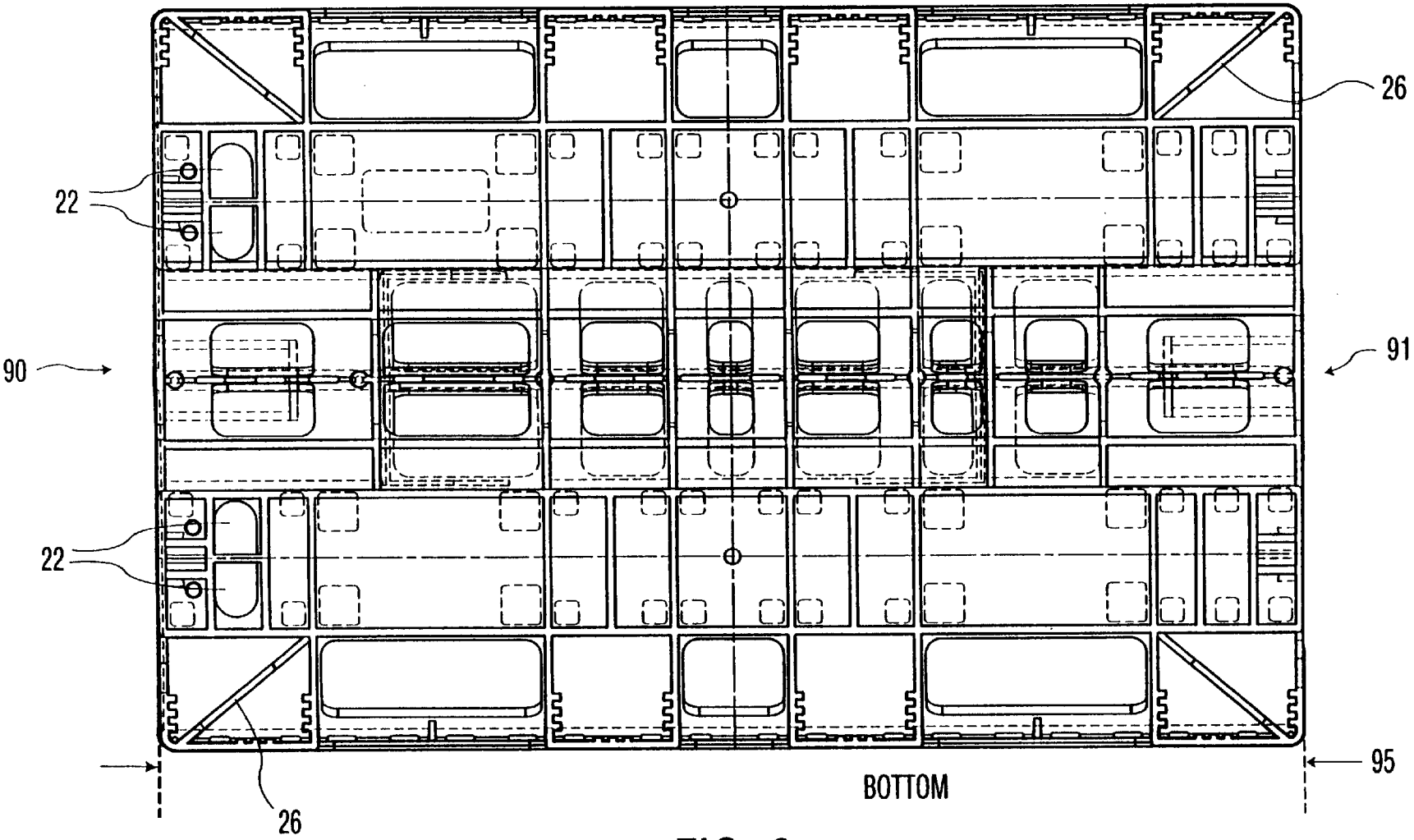
FIG. 6 is a bottom view of the exemplary unit according to the first exemplary embodiment.

FIG. 6 is a bottom view of the unit of the first exemplary embodiment. The front 90 and the rear 91 are separated by a length 95. This bottom view shows the holes 22 which function as drain holes, and alternatively may be used as handles. Additional holes may be provided in the unit. Recessed lower alignment ribs 26 correspond to upper alignment ribs 13 (FIG. 4). Ribs 13 extend above the top of a stacked unit (not pictured) to mate with recessed ribs 26 to align the units. When the units are stacked, recessed ribs 26 are substantially in contact with ribs 13 extending from the top of a subjacent crate to provide strength points.

Figure 7:
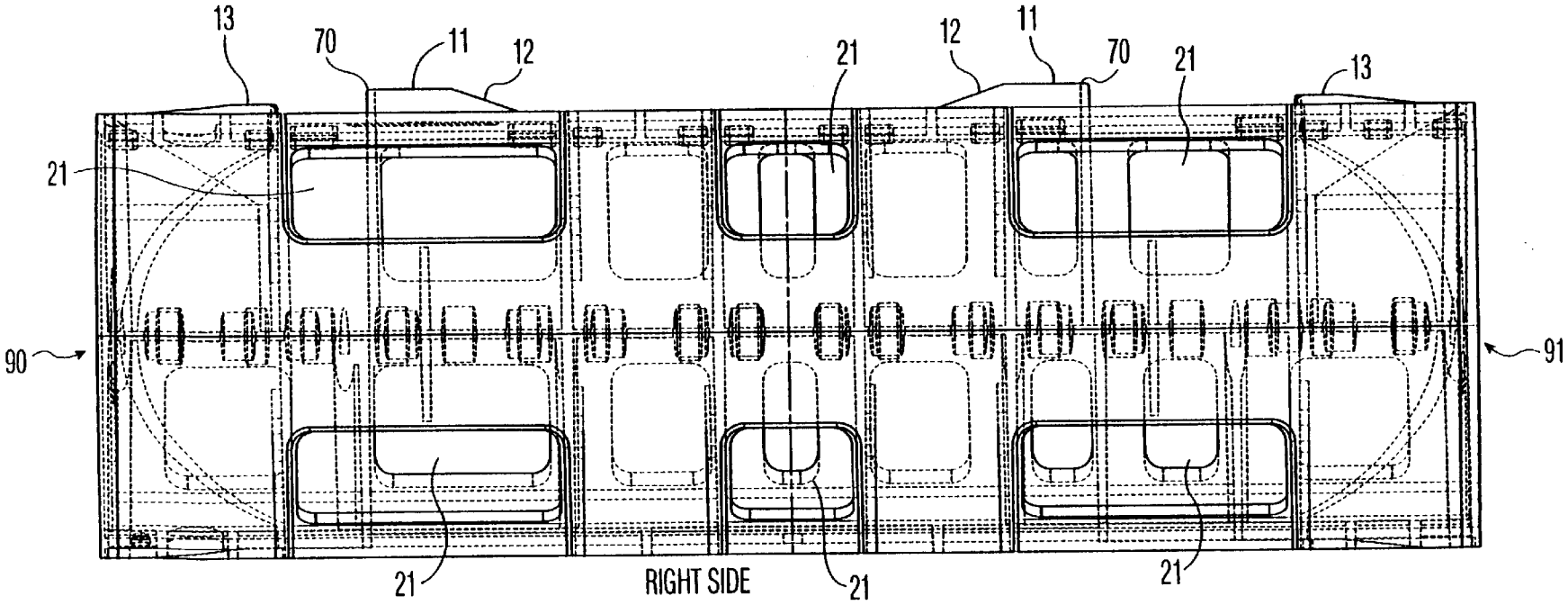
FIG. 7 is a side view of the exemplary unit according to the first exemplary embodiment.

FIG. 7 is a side view of the exemplary unit described above. Windows 21 provide a view of the loaded bottles. Alignment ribs 13 project upward from the corners. Raised portions 11, upper ribs 70, and ramps 12 provide the locking/alignment unit and allow for sliding one unit over another.

ii. Second Exemplary Embodiment of the Stackable Unit

Figure 20:
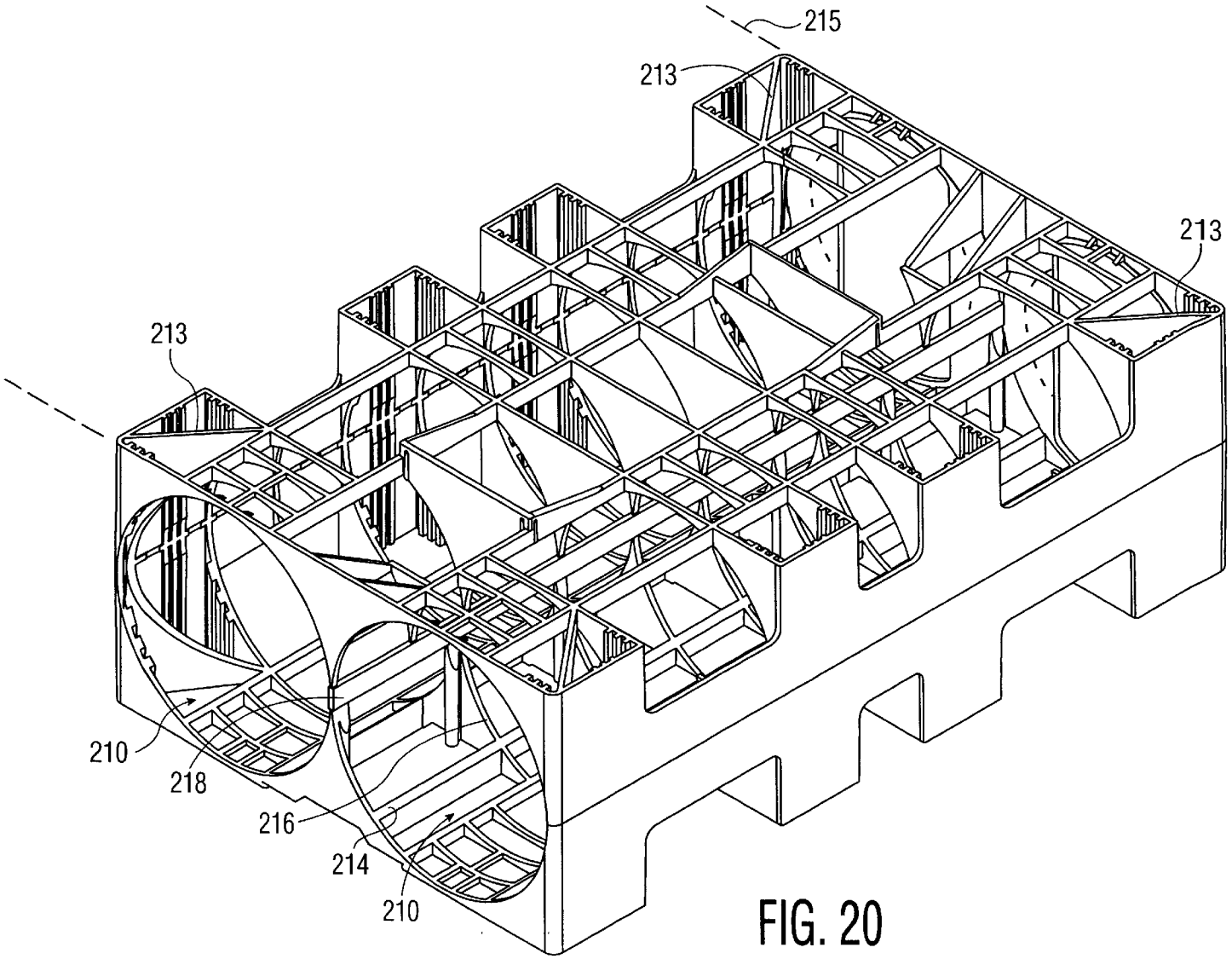
FIG. 20 is a perspective view of a second exemplary embodiment of a single unit in the rack system of this invention.

FIG. 20 shows a second exemplary embodiment of a single unit in the rack system of this invention. FIG. 20 is a perspective view similar to the perspective view of the first exemplary embodiment of the unit shown in FIG. 1. The features shown and described in conjunction with FIG. 1 are also included in the second exemplary embodiment as shown in FIG. 20, with the exception being that upper alignment ribs 213 are substantially flat and coplanar with upper plane 213 and that the hollow retaining members 210 do not include a solid retaining wall. Hollow retaining members 210 include an inner boundary formed of a discontinuous surface defined by edges of a plurality of supporting beams. The supporting beams extend to at least one of the top portion and the bottom portion of the stackable unit. The supporting beams include beams extending along the longitudinal direction 214, 218 and beams extending along the lateral direction 216. Beams such as beam 214 which extends along the longitudinal direction are provided to allow the bottles which are retained within the hollow retaining member to slide easily along the discontinuous surface of hollow retaining member 210.

iii. Third Exemplary Embodiment of a Stackable Unit

Figure 21:
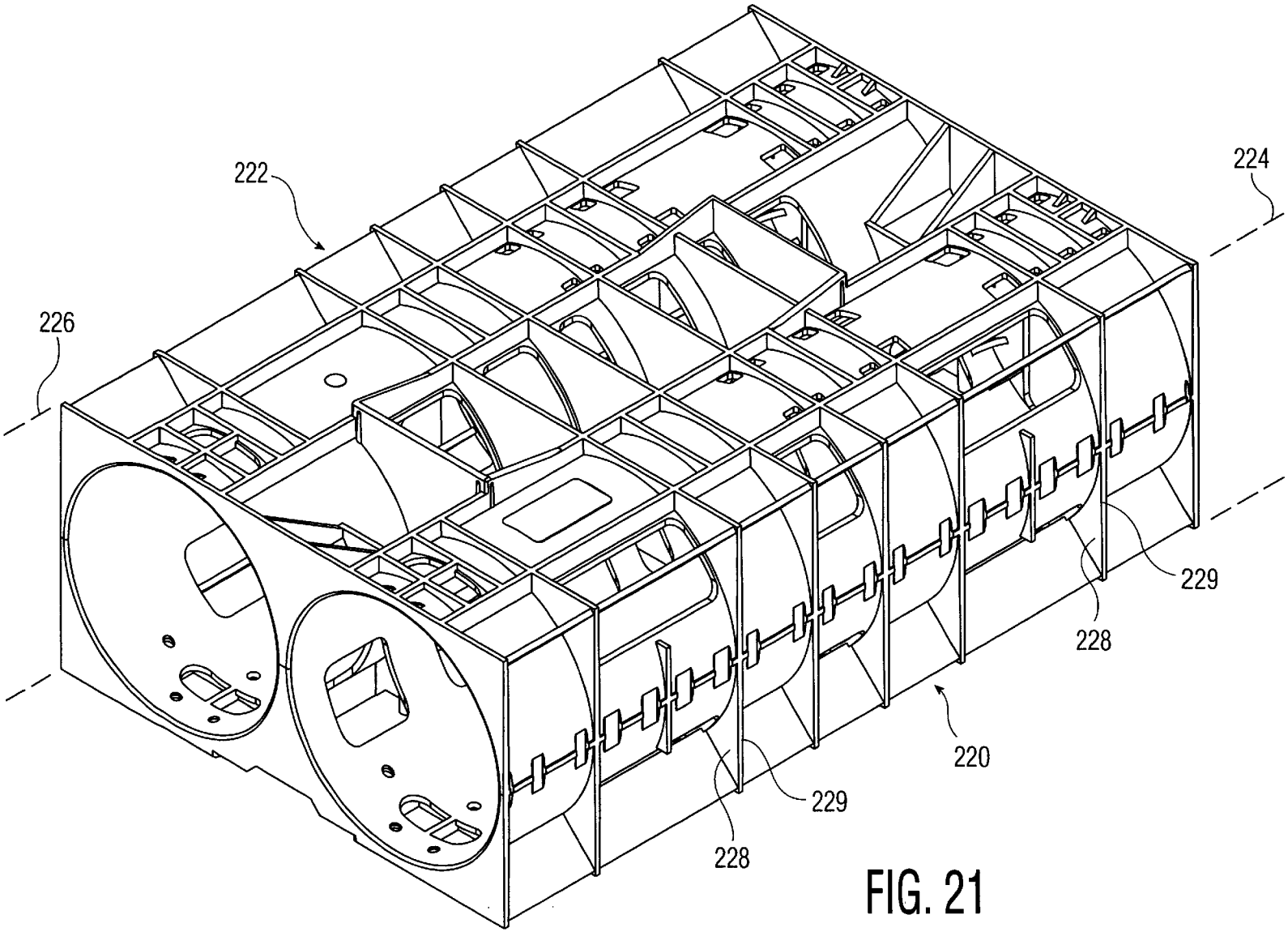
FIG. 21 is a perspective view of a third exemplary embodiment of a single unit in the rack system of this invention.

FIG. 21 shows a third exemplary embodiment of a single unit in the rack system of this invention. FIG. 21 is a perspective view similar to the perspective view of the first exemplary embodiment of the unit shown in FIG. 1. The features shown and described in conjunction with FIG. 1 are also included in the third exemplary embodiment shown in FIG. 20 with the exception being that upper alignment ribs 13 (shown in FIG. 1A) are not included. In addition, the peripheral wall 89 shown in FIG. 1 does not extend along sides 220 and 222 of the unit shown in FIG. 21. According to the third exemplary embodiment, sides 220 and 222 are formed of vertical planes 224 and 226 respectively. The vertical planes are defined by a number of support ribs. Vertical plane 224 is defined by a number of vertical support ribs 228 which extend from top to bottom, include edges 229 which form vertical plane 224, and extend inwardly.

iv. Fourth Exemplary Embodiment of a Stackable Unit

Figure 22:
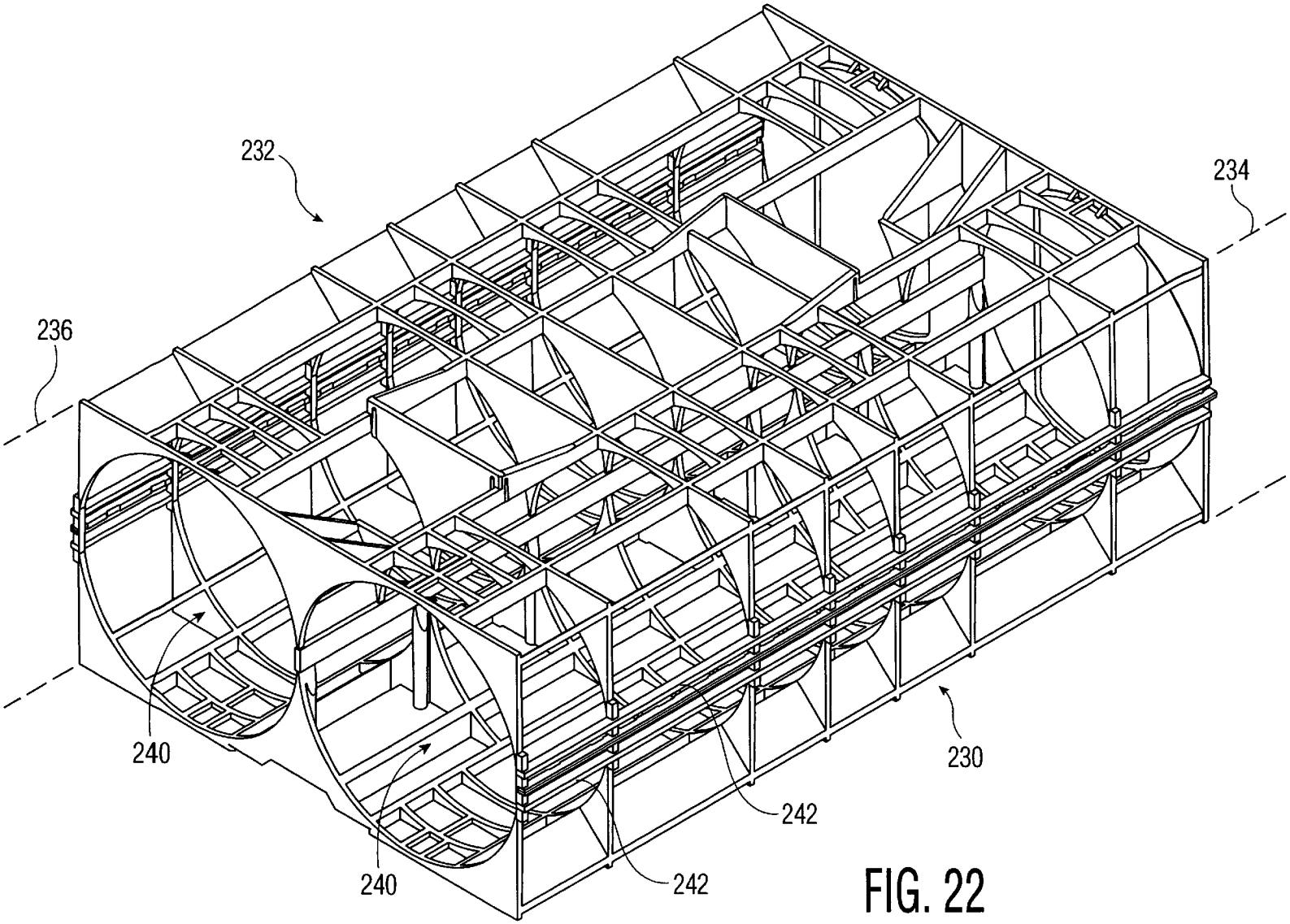
FIG. 22 is a perspective view of a fourth exemplary embodiment of a single unit in the rack system of this invention.

FIG. 22 shows a fourth exemplary embodiment of a single unit in the rack system of this invention. FIG. 22 is a perspective view similar to the perspective view of the first exemplary embodiment of the unit as shown in FIG. 1. Similar features are as shown and described in conjunction with the first exemplary embodiment. According to the fourth exemplary embodiment, alignment ribs are not included, the hollow-retaining members 240 do not include a solid retaining wall. Rather, they include an inner boundary defined by edges of longitudinally and laterally extending ribs as shown and described in conjunction with FIG. 20. The fourth exemplary embodiment also does not include peripheral walls along the sides. Sides 230, 232 are formed of vertical planes 234 and 236 respectively and longitudinal support beams 242 which extend along sides 230, and 232 and protrude outwardly from vertical planes 234, 236, respectively.

It should be understood that the locking mechanism shown in FIGS. 20–22 may be as described in conjunction with the first exemplary embodiment. It should be further understood that the embodiments shown in FIGS. 20–22 may additionally or alternatively include raised alignment ribs as shown and described in conjunction with FIG. 1A, and corresponding recessed ribs as shown in FIG. 2.

v. Fifth Exemplary Embodiment of a Stackable Unit

Figure 23:
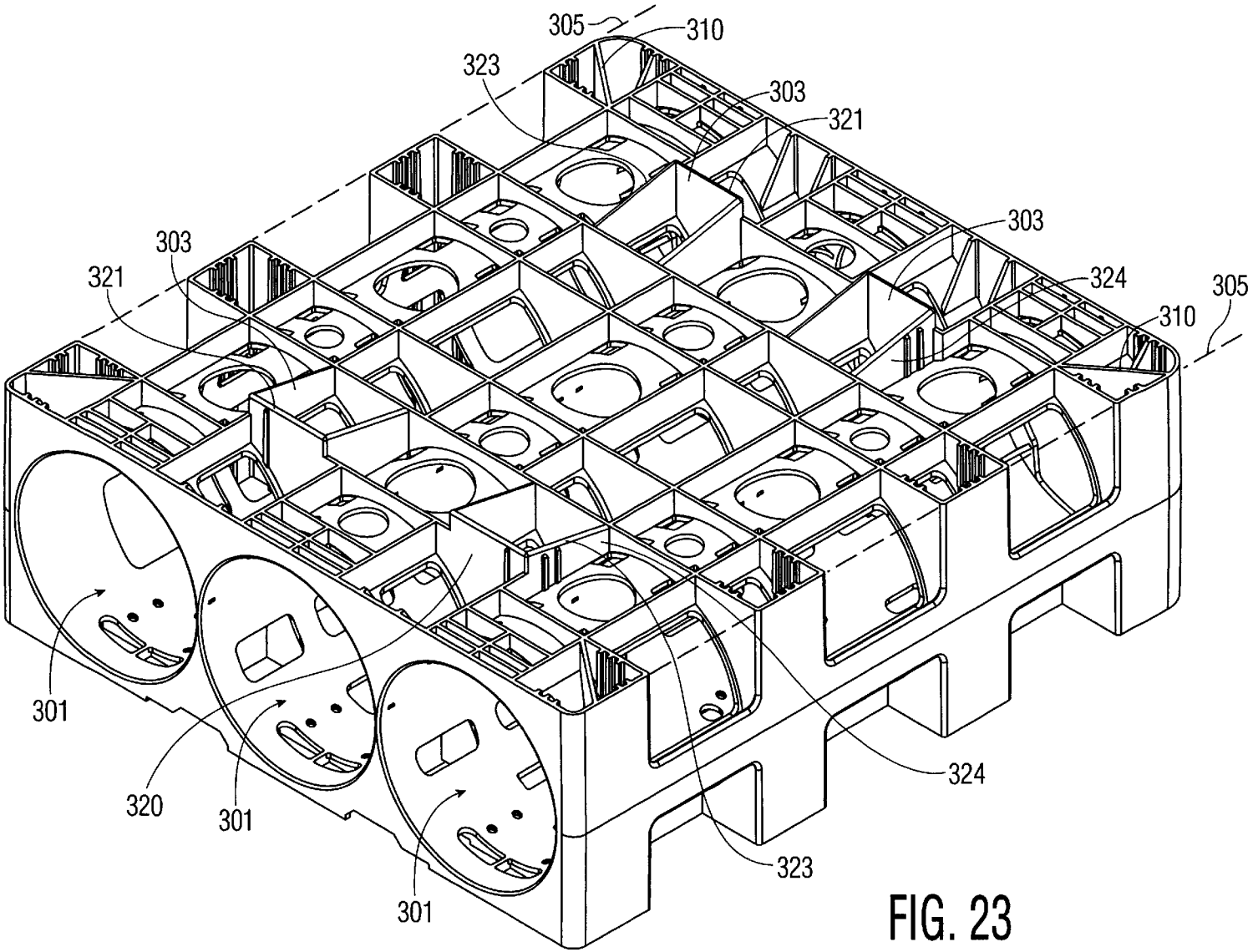
FIG. 23 is a perspective view of a fifth exemplary embodiment of a single unit in the rack system of this invention.

FIG. 23 illustrates a fifth exemplary embodiment of a single unit in the rack system of this invention. This unit is adapted to hold six bottles, three wide and two deep. The bottles are contained in each of three laterally situated hollow retaining members 301. The top of the unit defines upper plane 305. The top of the unit includes raised portions 303 each of which include an outer rib 321 and ramps 323. Raised portions 303 extend above upper plane 305, and are arranged in pairs, in regions of the top portion of the unit between adjacent hollow retaining members 301. For example, in an exemplary embodiment having only two hollow retaining members, only a pair of raised portions would be included.

Each raised portion 303 includes an outer surface 320. Raised portion 303 allows a unit stacked on top of the illustrated unit to lock into place and also allows for the upper stacked unit to slide onto and off of a subjacent unit, along the longitudinal direction as described in conjunction with raised portions 11 and longitudinal cavity 20 shown in FIGS. 1 and 3, respectively. Ramps 323 allow for a corresponding locking feature on the bottom of the unit (as depicted in FIG. 24) to slide over outer rib 321 and lock into place over raised portion 303.

Figure 24:
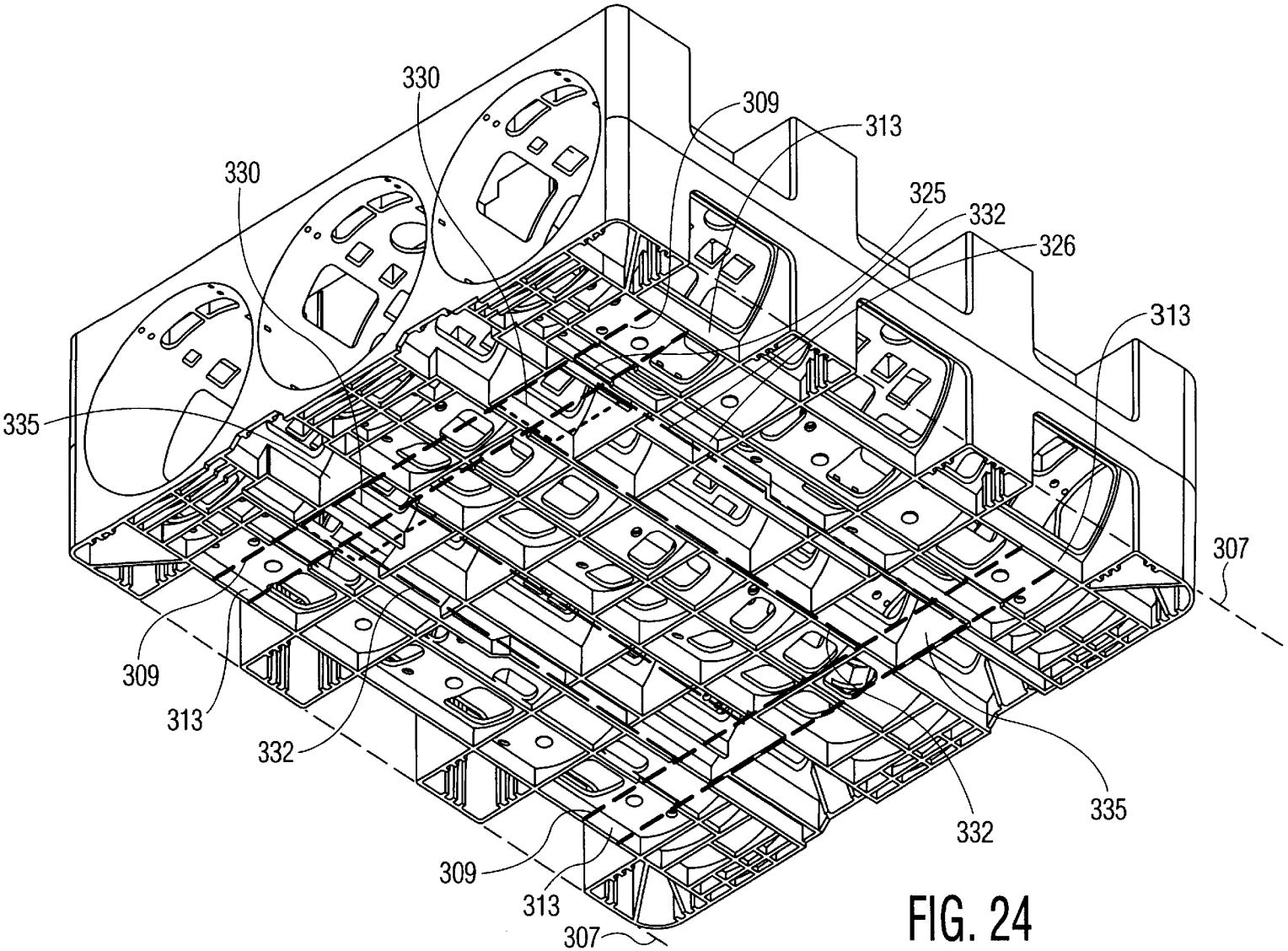
FIG. 24 is a perspective view showing the bottom of the unit according to the fifth exemplary embodiment.

FIG. 24 is a perspective view showing the bottom of the fifth exemplary embodiment depicted in FIG. 23. Similar to the first exemplary embodiment shown and described in conjunction with FIG. 2, the fifth exemplary embodiment includes a recessed longitudinal cavity 332 and an inner surface 335 at either end of the recessed longitudinally cavities 332. Recessed longitudinally cavities 332 are aligned with raised portions 303 as shown in FIG. 23, and provide for the longitudinal sliding and locking feature shown and described in conjunction with the first exemplary embodiment.

The lower portion of the crate also includes a pair of channels 309 which allows for a unit to slide laterally over a subjacent unit and to lock into locking position 330. Channels 309 are indented above lower plane 307 and are formed by a plurality of notches 325 formed within longitudinal ribs 326. Channels 309 are sized and positioned to allow for the raised units (303 shown and described in FIG. 23), including outer ribs 321 and ramps 323, to slide laterally through channel 309 after a unit has been placed over a subjacent unit and generally aligned along the longitudinal direction. Retaining walls 313 form the ends of channels 309 and prevent ramps 323 and outer surfaces 324 of a corresponding raised portion, from sliding laterally past that point. Channel 309 is usable as an alignment feature provided that raised portions 303 of an upper portion of a subjacent unit, are positioned inside or beneath retaining wall 313 when one unit is stacked over a subjacent one. When raised portions 303 of a subjacent unit are nested within corresponding locking positions 330 of a unit being stacked, the units are locked into position.

Although channel 309 is shown and described in conjunction with an exemplary unit having three hollow retaining members and including peripheral walls and a solid retaining wall within the hollow retaining members, it should be understood that channel 309 and the alignment features it provides, may also be used in conjunction with the other described embodiments.

vi. Exemplary Embodiment of Stacked Units

Figure 8:
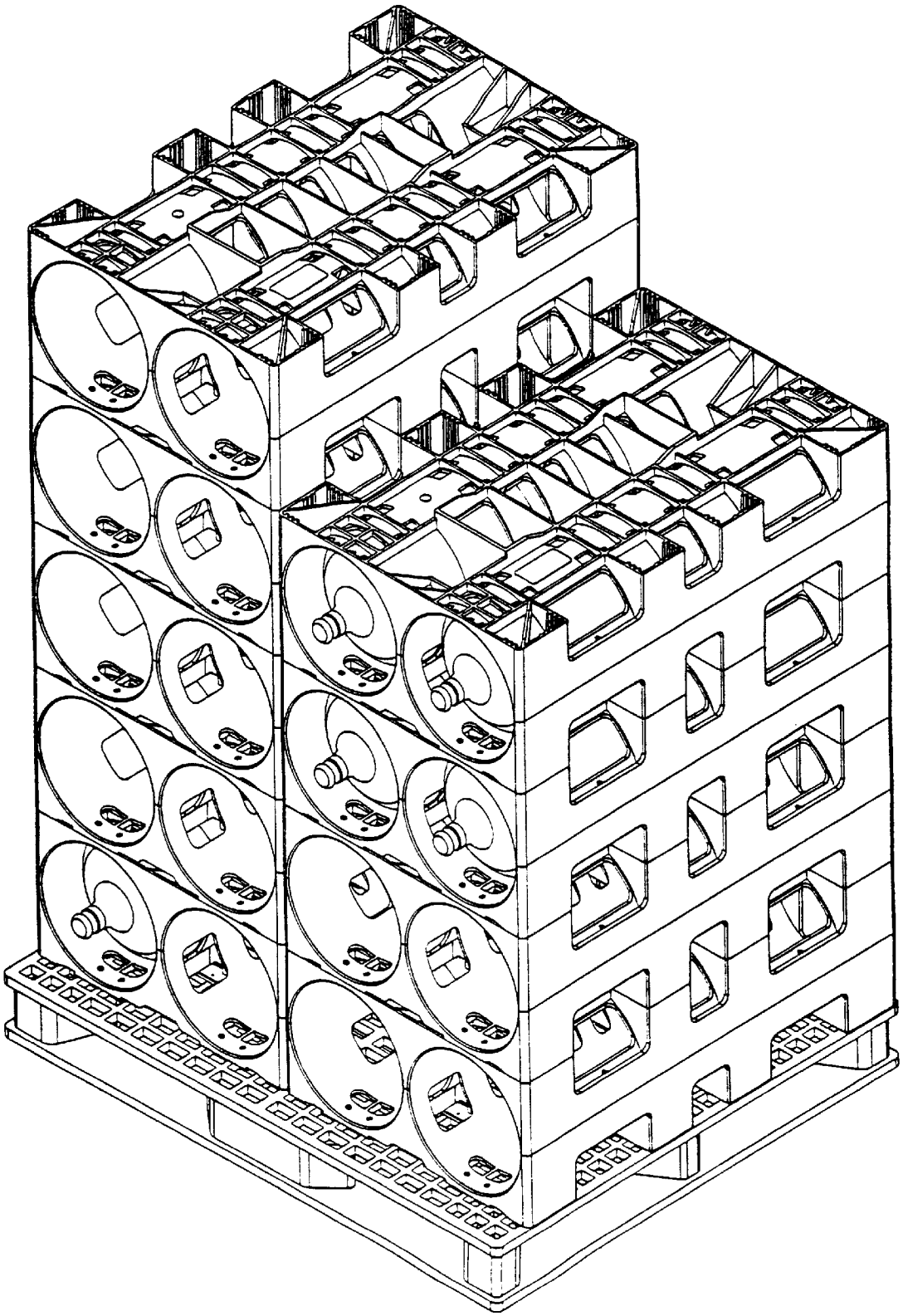
FIG. 8 shows an exemplary stacked model of several units on a pallet.

FIG. 8 shows an exemplary stacked model in which nine of ten units of the first exemplary embodiment, have been assembled.

In addition to the locking/alignment features of the exemplary embodiment, other alignment/locking means may be used. The units may be secured together permanently or releasably, such as during transport. Various fastening means may be used. The fastening means may be part of the unit or an external component, such as a strap. In an exemplary embodiment, bosses may be included to project upward from the top of a crate and the bottom of a crate may include receiving units to receive the bosses and secure a unit stacked on top of another. In a preferred embodiment, the bosses may project from support beams (feature 85 in FIG. 1) which form the upper plane 73.

Figure 9:
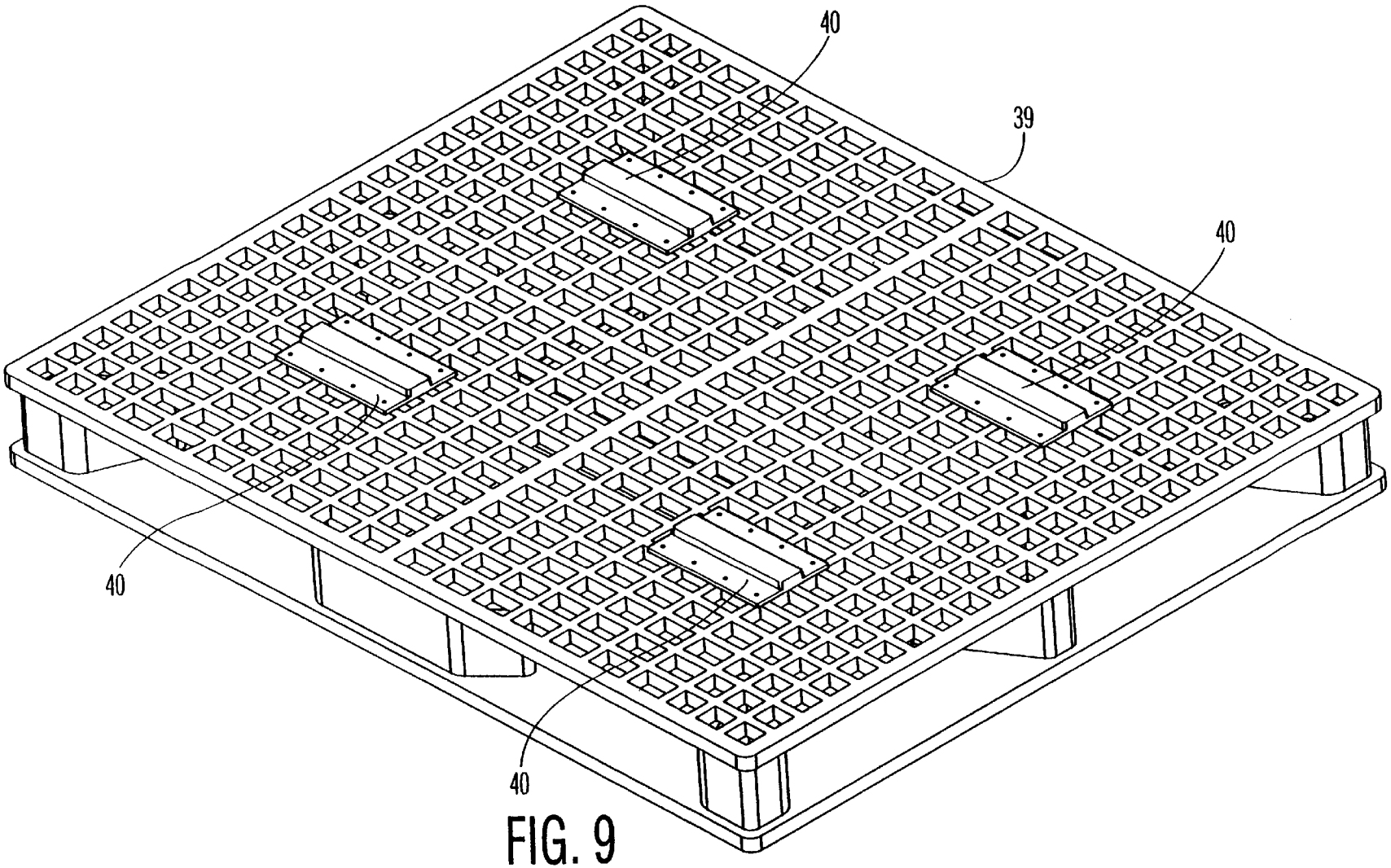
FIG. 9 is a perspective view of detachable alignment units attached to a pallet.

It may be understood by one of skill in the art that other suitable alignment/locking means may also be used. The present invention also contemplates the combination of the stacked modular unit and a molded pallet whereby the bottom unit in the rack system may be positioned on the pallet with the use of a detachable alignment unit affixed on top of the pallet. As illustrated in FIG. 9, the pallet 39 may have raised attachments 40 which serve as detachable alignment units onto which a unit may be aligned and stacked. Recessed longitudinal cavities 20 (FIG. 2) are configured to cooperate either with the locking rib 23 (FIG. 2) on the underside of each unit to lock the unit on to raised portion 11 (FIG. 1) of a subjacent unit or alternatively onto detachable alignment units 40 affixed to a pallet. The detachable alignment units 40 are adapted to align the units and incorporate the interlocking (and sliding) feature of this invention, and are positioned so that the units may be stacked in either direction on the pallets.

Figure 10:
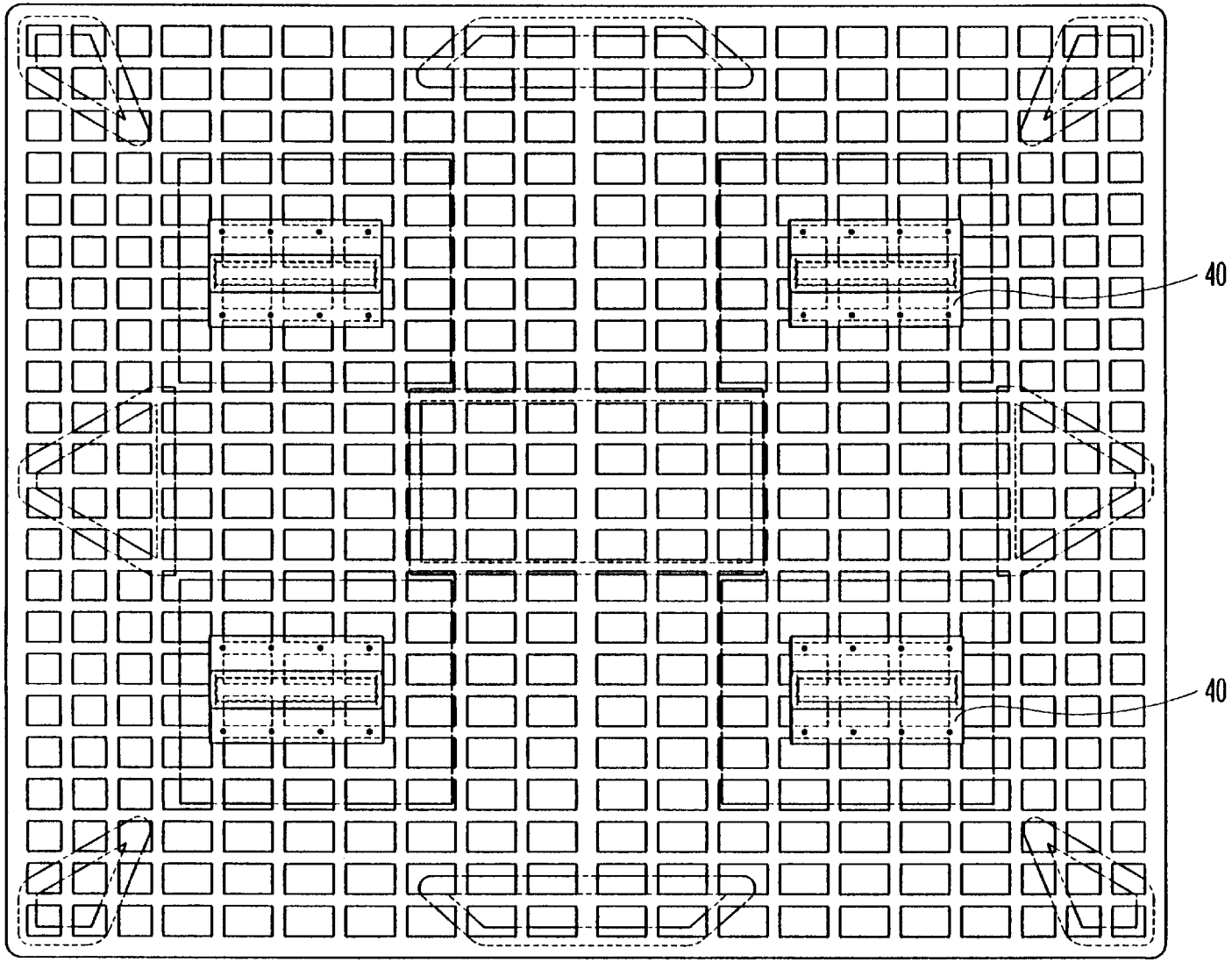
FIG. 10 is a top view of a pallet with detachable alignment units.

FIG. 10 is a top view of the pallet with detachable alignment units 40 positioned on the pallet.

Figure 11:
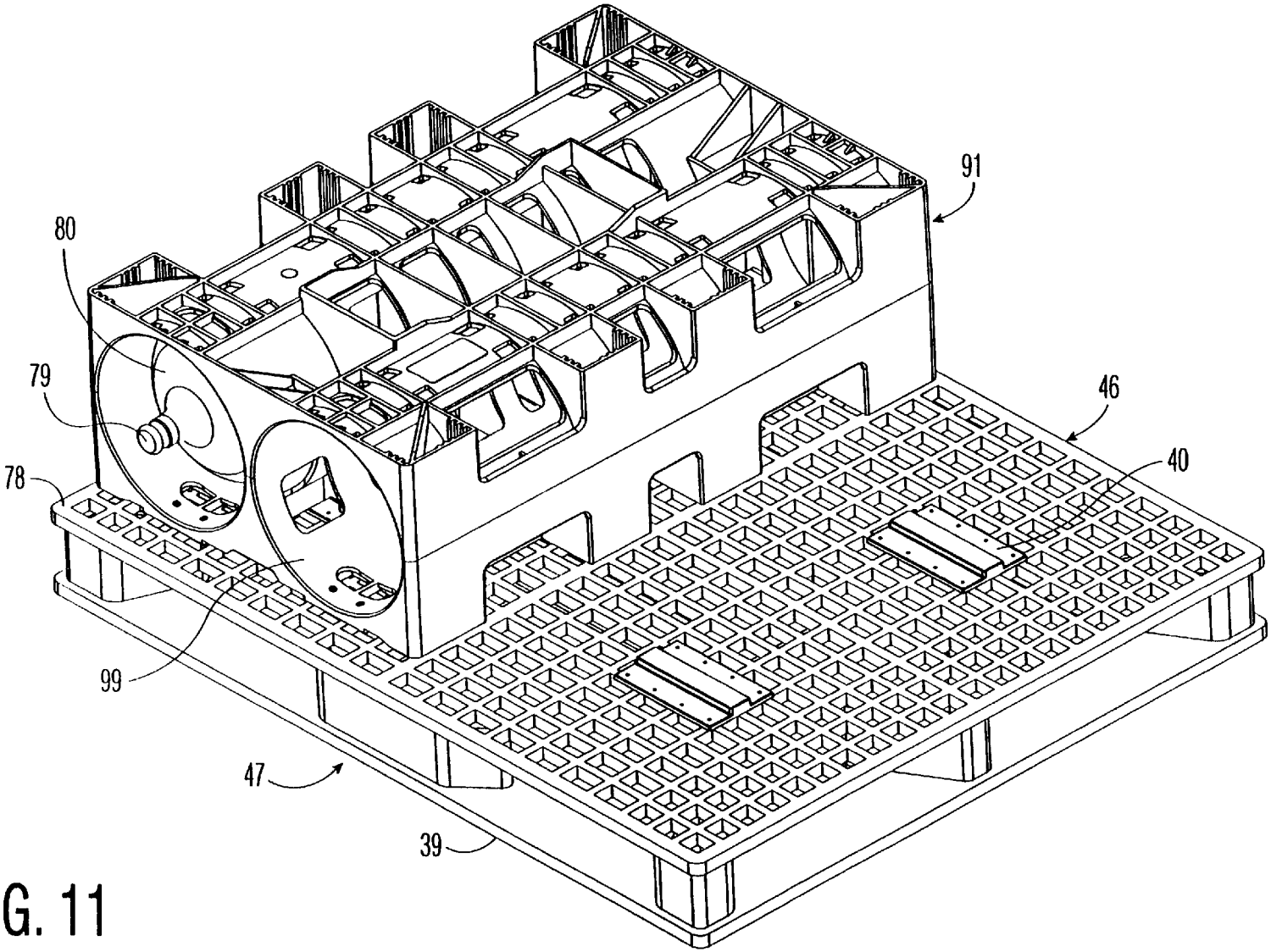
FIG. 11 is a perspective view of a pallet with one unit loaded onto the pallet and aligned onto a detachable alignment unit.

FIG. 11 is a perspective view of such an exemplary pallet 39 with one unit of the first exemplary embodiment loaded onto the pallet and locking onto detachable alignment unit 40. Note that an exemplary crate unit may be sized, and that the detachable alignment units 40 may be positioned so that the crate can retain two five gallon water bottles and fit on an industry standard pallet 39 whereby the rear of the unit 91 essentially lines up with the back of the pallet 46 and the front of the unit 90 does not extend fully to the front of the pallet 47, producing a foot 78 part of the pallet. In this manner, two industry standard water bottles 80 may be stacked in contact with one another, whereby the neck 79 of the front bottle protrudes slightly out of the front opening 99 of the crate and overhangs the foot 78, to prevent damaging the bottles. In this manner, no cap to crate contact occurs during transport.

Figure 12:
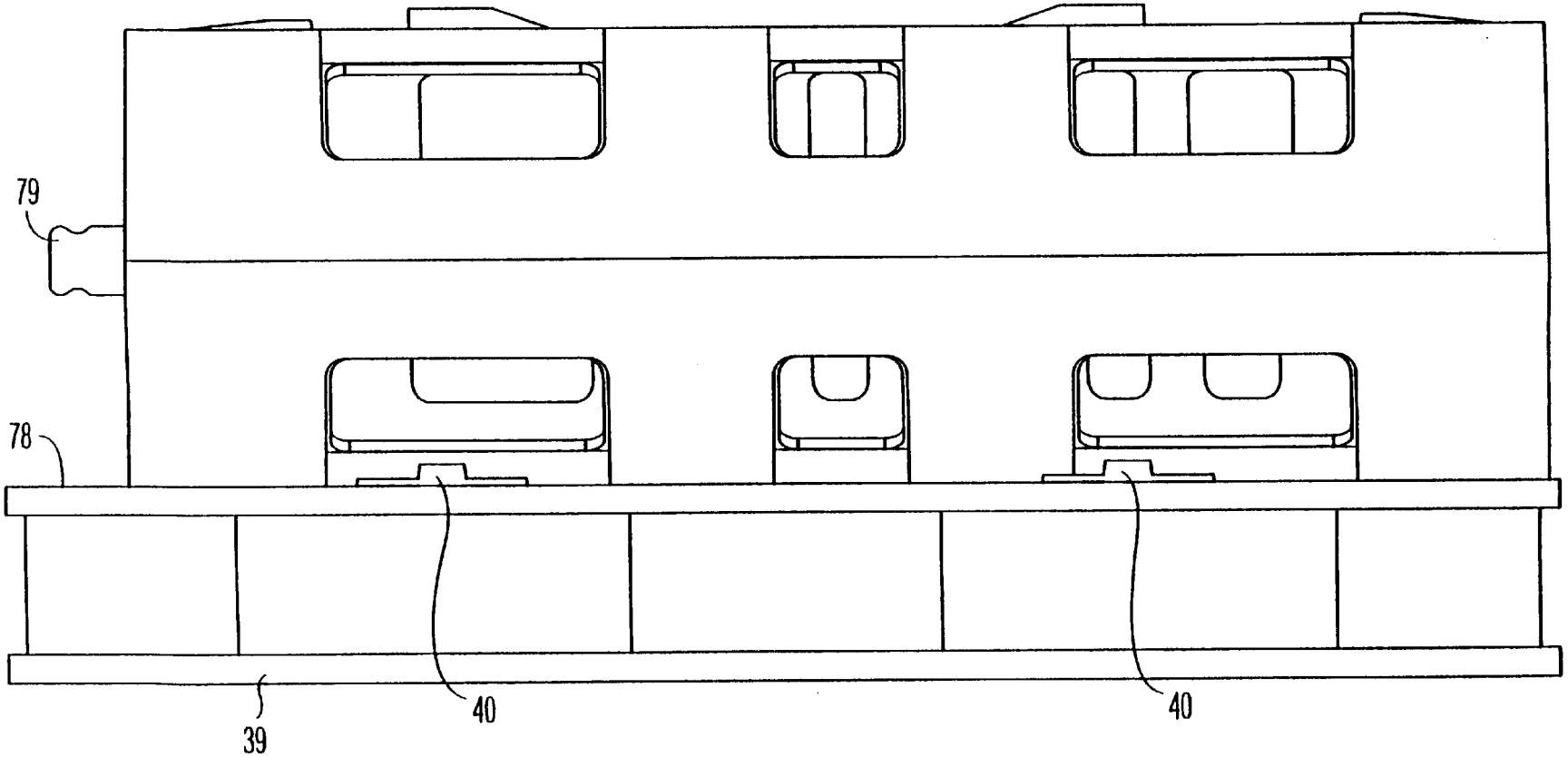
FIG. 12 is a side elevation view of a pallet with one unit loaded onto the pallet and aligned onto detachable alignment units.

FIG. 12 is a side elevation view of the first exemplary embodiment of the stackable crate on an exemplary pallet also depicted in FIG. 11. A stackable crate loaded onto the pallet is aligned with, and locked onto raised attachments 40. The neck 79 of the front bottle 80 protrudes slightly from the crate and overhangs the foot 78 of pallet 39.

Figure 13:
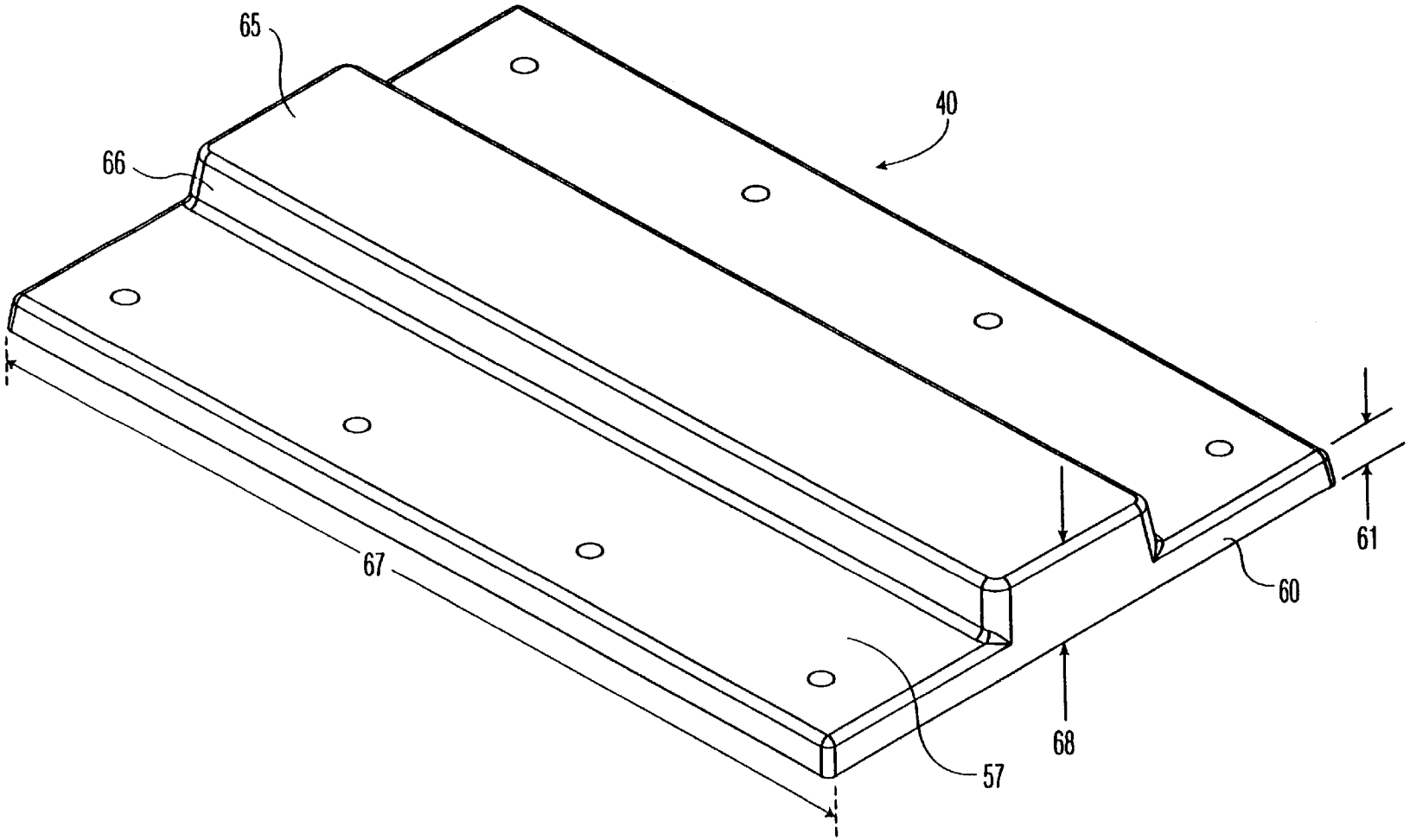
FIG. 13 is a perspective view of a detachable alignment unit.

FIG. 13 is a perspective view of an exemplary embodiment of the detachable alignment unit 40 which may be secured to a pallet to position and lock the stackable crate unit into place onto the pallet. The detachable alignment units 40 include a base 60, a central rib 65, and a foot 57 on either side of the central rib. The foot 57 has a height 61 which is less than or equal to the depth of indentation 75 of the locking rib 23 as depicted in FIG. 2. The detachable alignment units 40 also include a central rib 65 with a height 68 which is less than or equal to the cavity depth 72 (depicted in FIG. 2) enabling the detachable alignment unit 40 to fit within the recessed longitudinal cavity of FIG. 2, with a foot 57 positioned under the locking rib 23. The detachable alignment units 40 may be affixed to the pallet using any method common in the art.

The central rib 65 includes front and rear faces 66 which will contact the inner surface of the locking rib of the bottom of a unit stacked on top of the alignment units, when the unit is positioned into place on top of the alignment unit 40. The length 67 of the detachable alignment unit 40 is this exemplary embodiment is chosen to be substantially equal to the length 71 of the upper rib 70 of FIG. 1 so as to prevent lateral sliding of a unit locked onto the detachable alignment unit 40. As would be obvious to one skilled in the art, the detachable alignment units may alternatively, be of any suitable shape. By way of example, they may be pyramidal shaped in the longitudinal (locking) direction, or may not include the rounded edges as depicted.

Figure 14:
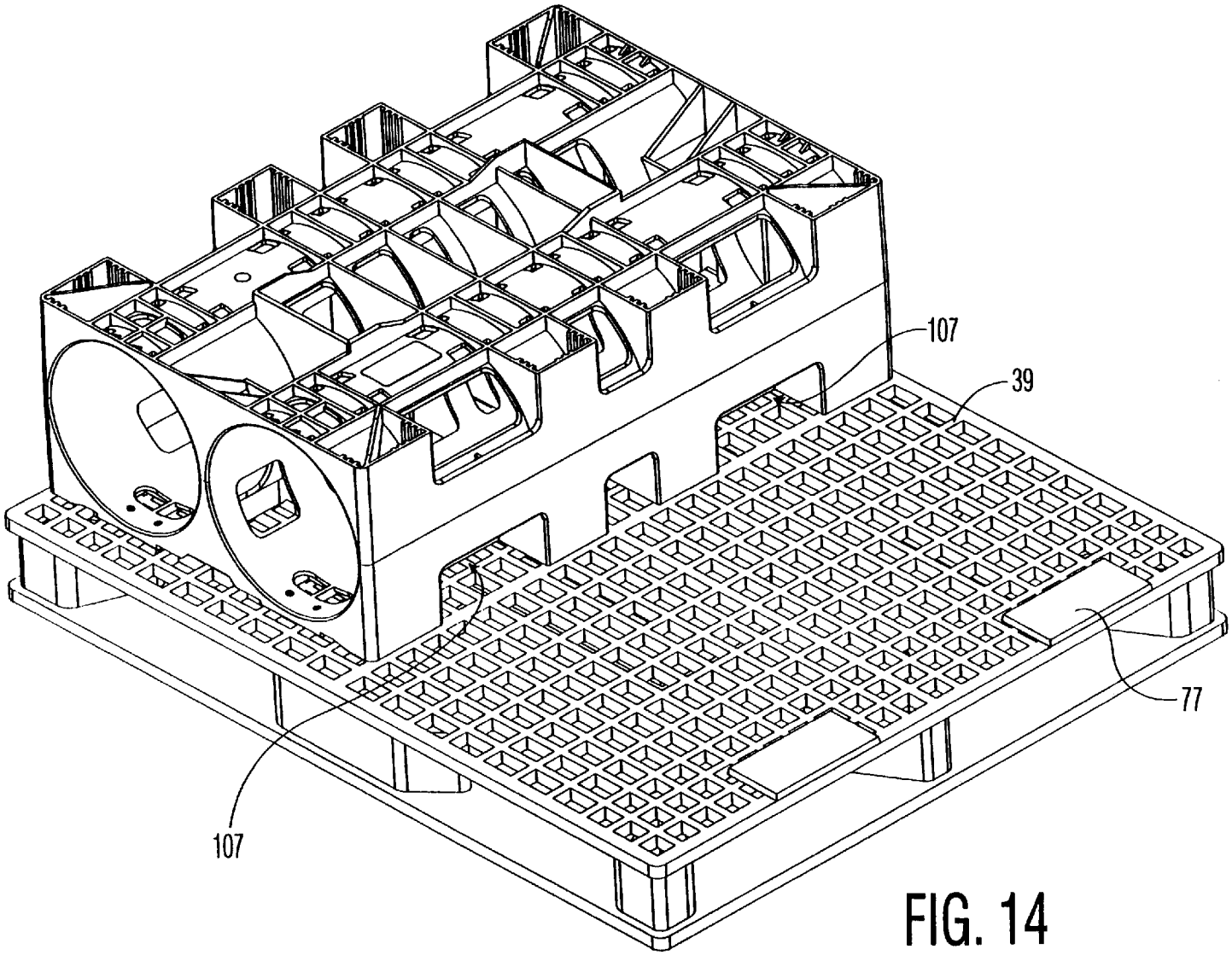
FIG. 14 is a perspective view of a pallet with one unit loaded onto the pallet and aligned using an alternative embodiment of a flat detachable alignment unit.

FIG. 14 represents an alternative embodiment of detachable alignment units which may be used to align the stackable crates onto a pallet, and lock them into place. Rectangular members 77 are secured to the pallet 39. Rectangular members 77 fit within openings 37 formed within the bottom of the stackable unit to align the stackable units onto the pallet 39.

It should be understood that, although the first exemplary embodiment of a stackable unit of the present invention has been shown in conjunction with the features shown in FIGS. 8, 11, 12 and 14, the second, third, and fourth exemplary embodiments as described above, could have been used alternatively to demonstrate the features of FIGS. 8, 11, 12 and 14. Each of the second, third, and fourth exemplary embodiments may contain the locking and alignment features as described in conjunction with the first exemplary embodiment, and may therefore be stacked on the pallets using alignment features shown and described in conjunction with FIGS. 8, 11, 12 and 14.

Figure 15:
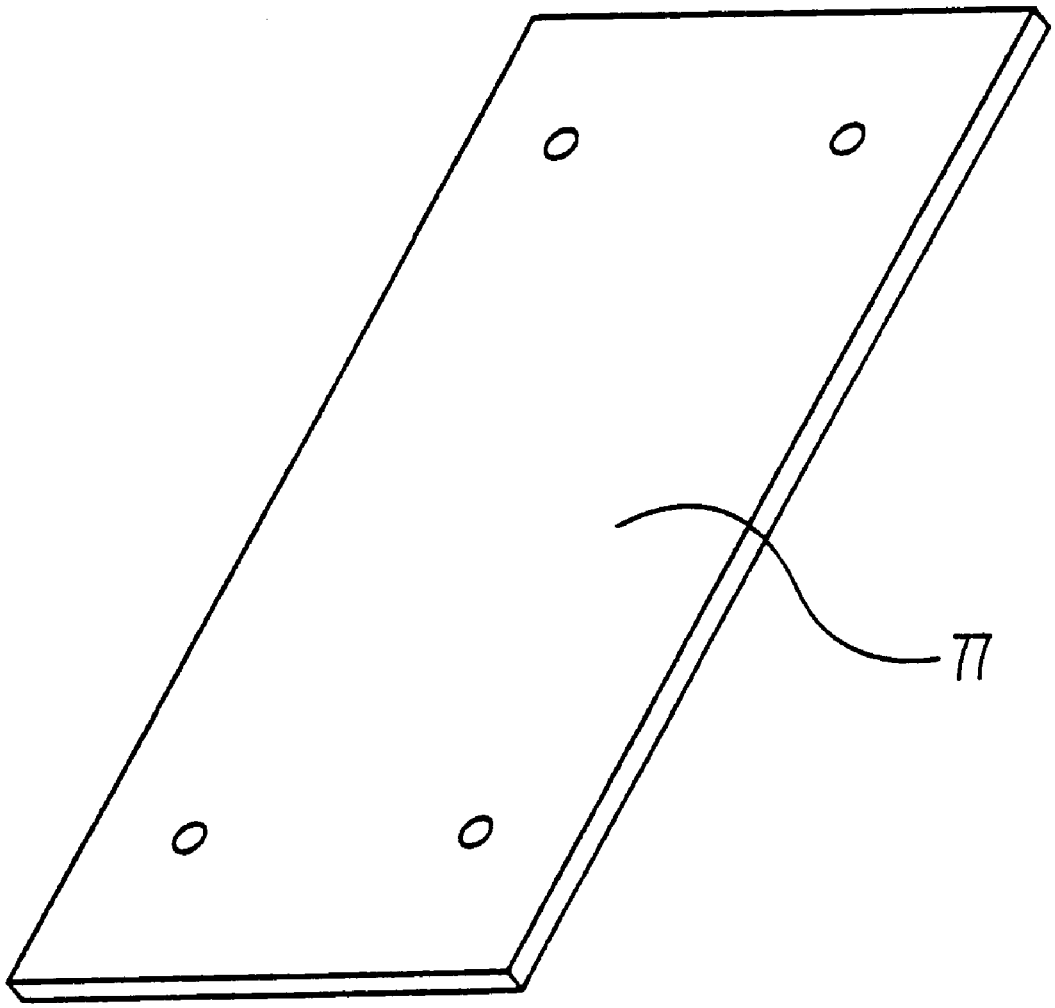
FIG. 15 illustrates an alternative embodiment of a detachable alignment unit.

FIG. 15 is a perspective view of a rectangular member used as a detachable alignment unit 77 for aligning the stackable crates to the pallet. However, it can be appreciated by one familiar with the art, that the rectangular member is presented by way of example. The detachable alignment units may be of any suitable shape capable of fitting within a corresponding opening or indentation formed in the bottom of the unit, to align and lock the units into place on the pallet.

Figure 16:
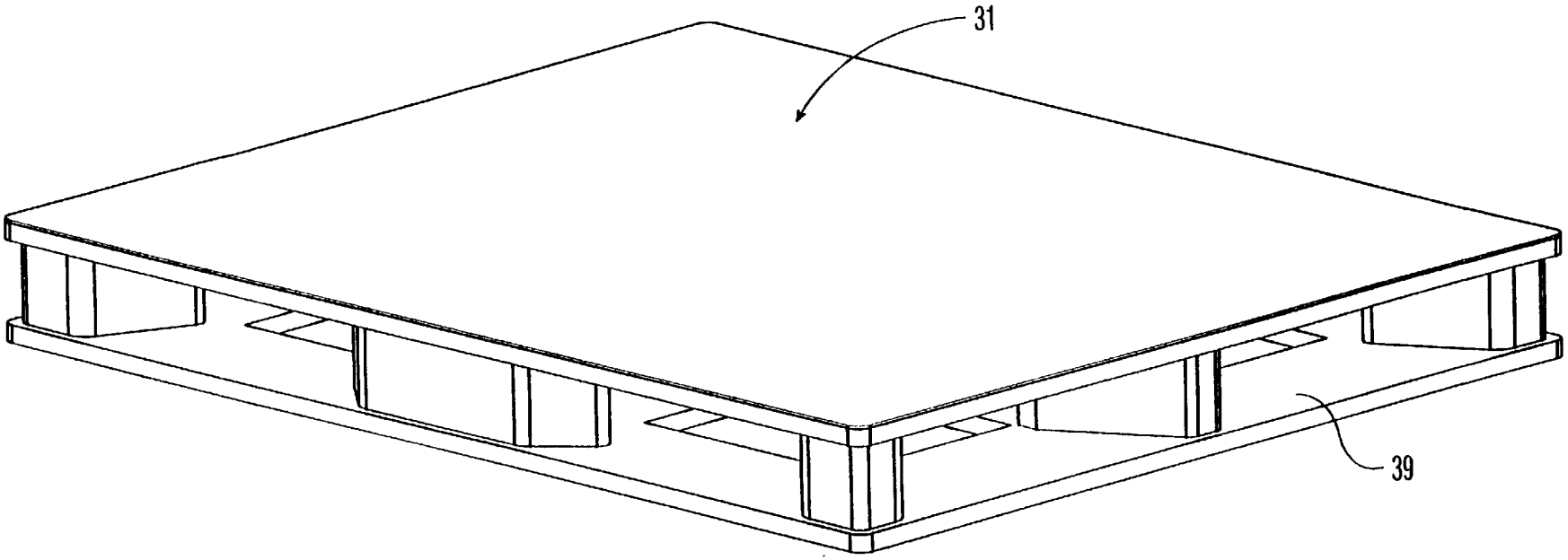
FIG. 16 is a perspective view of a pallet having a friction pad as an upper surface.

FIG. 16 is a perspective view of an exemplary embodiment of an alternative feature for securing the stacked unit into position on the pallet. Pallet 39 includes a friction pad 31 as its top surface. The friction pad is used to provide friction between the pallet and a stacked unit to maintain the stacked unit (not shown) in position and to prevent slippage without additional locking features. In a preferred embodiment, the friction pad 31 may be a rubber mat, but other suitable materials may be used.

Figure 17:
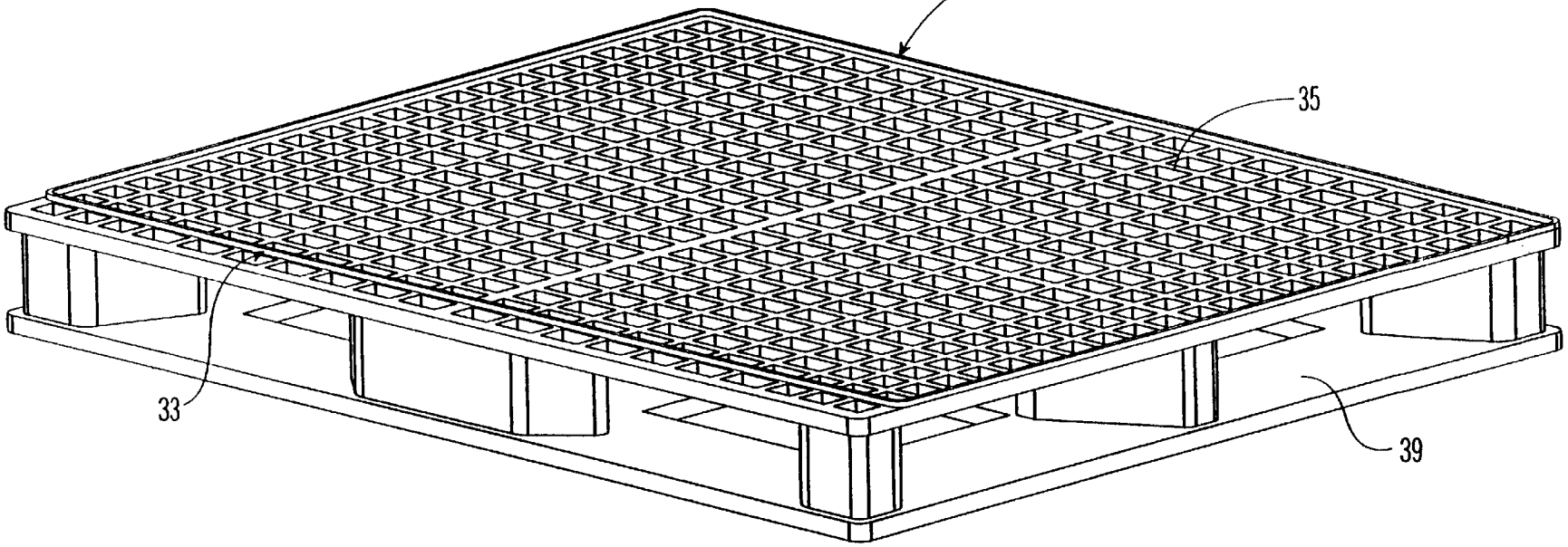
FIG. 17 is a perspective view of a pallet with a retaining curb on its upper surface.

FIG. 17 is an alternative embodiment of the present invention. Pallet 39 includes a retaining curb 33 which protrudes above top surface 35. Retaining curb 33 extends laterally about the top surface 35 to form an outline which is configured and sized to snugly receive one or more units (not shown) placed on the pallet. In FIG. 17, the retaining curb 33 is sized and shaped to accommodate two 2×2 units disposed side by side on an industry standard pallet, but the retaining curb 33 may be sized and shaped to accommodate a variety of sizes of stackable units of the present invention, stacked individually or side by side on a pallet.

Figure 18:
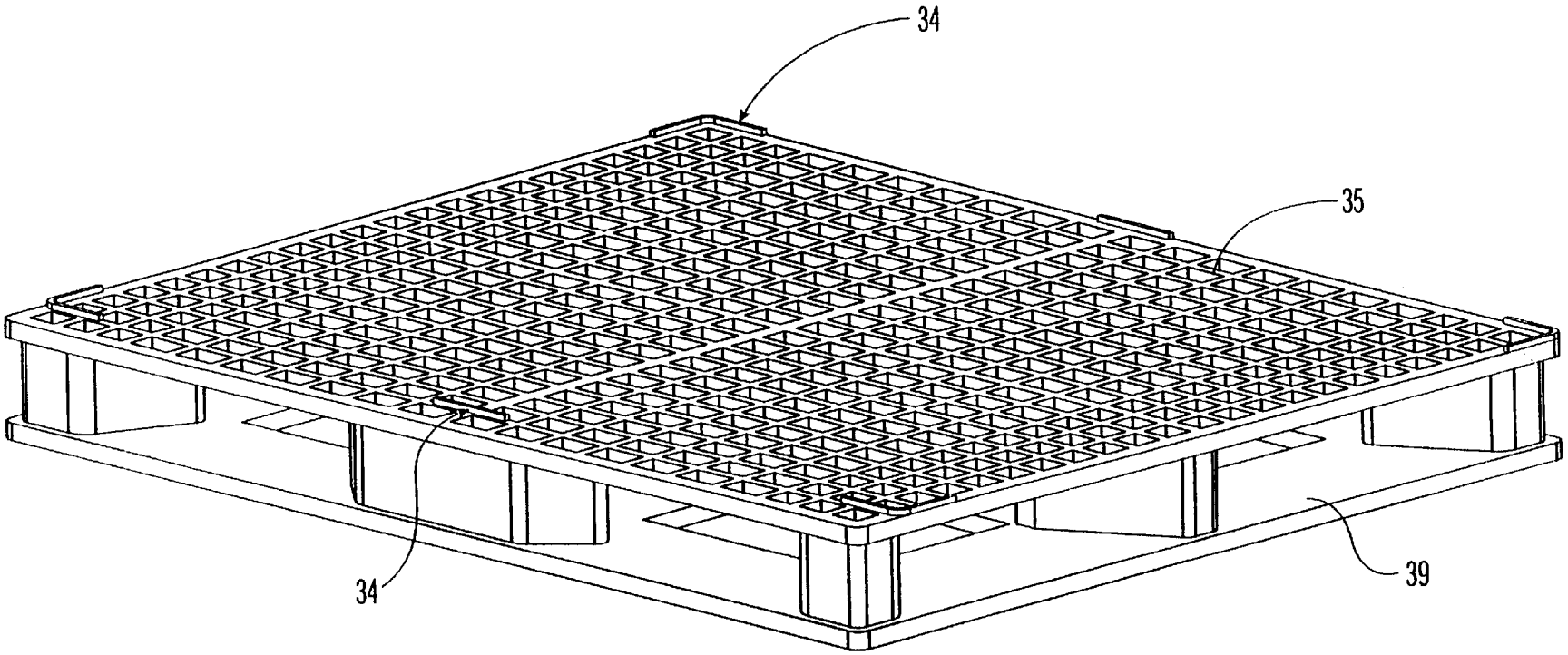
FIG. 18 is a perspective view of a pallet with an alternate embodiment of a retaining curb on its upper surface.

FIG. 18 is an alternative embodiment of the retaining curb shown in FIG. 17. In the present embodiment, the retaining curb 34 does not form a continuous curb extending to form the outline, but serves the same function. Retaining curb 34 may also be sized and configured to accommodate a variety of sizes of stackable units of the present invention, stacked individually or side by side on a pallet.

vii. Sixth Exemplary Embodiment of a Stackable Unit

Figure 25:
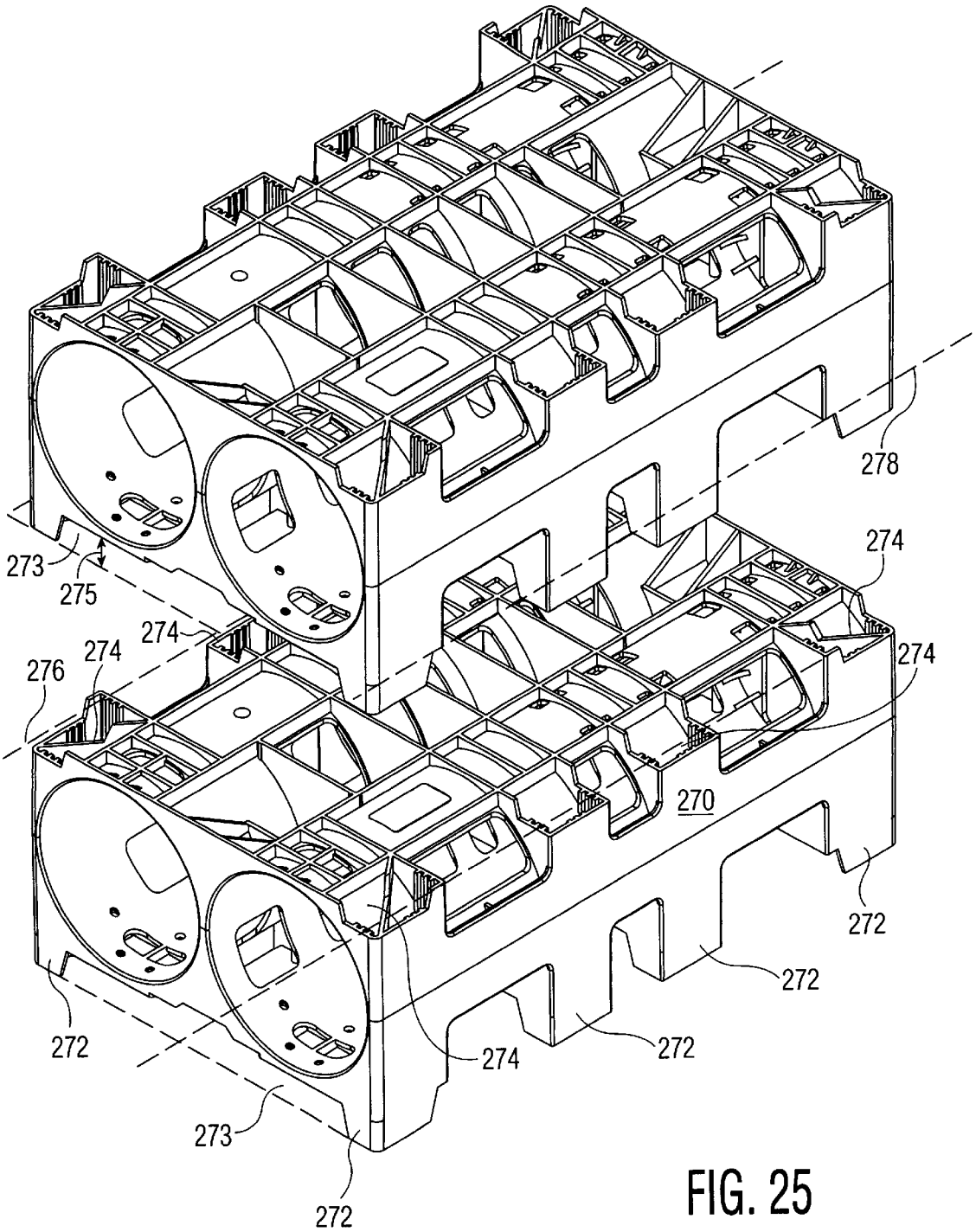
FIG. 25 is a perspective view of two units of a sixth exemplary embodiment in the rack system of this invention.
Figure 26:
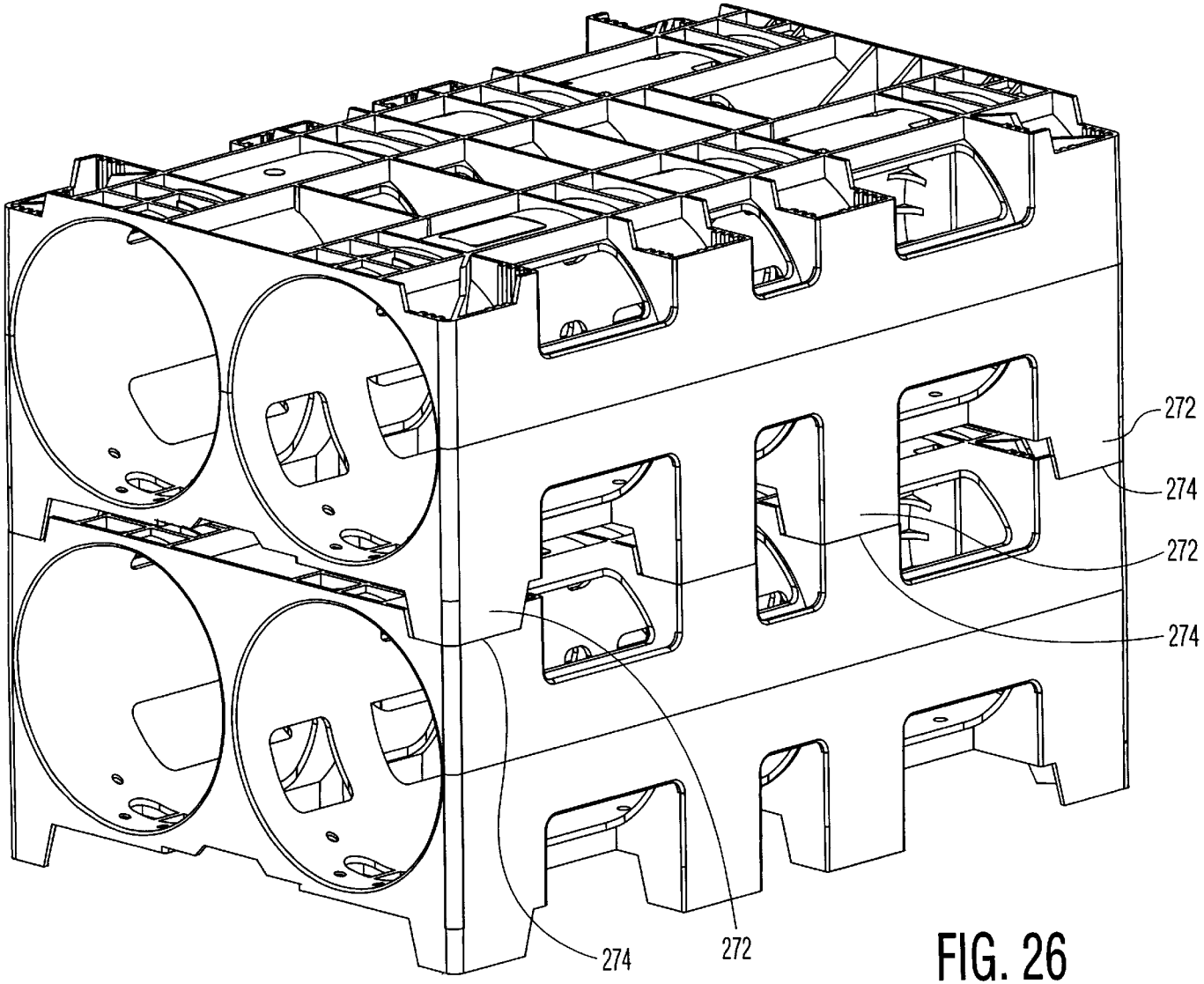
FIG. 26 is a perspective view of the two units shown in FIG. 25, stacked upon each other.

FIGS. 25 and 26 show another exemplary embodiment of a stackable unit according to this invention. FIG. 25 shows two units of a sixth exemplary embodiment positioned to be stacked upon one another. The stackable unit shown in FIG. 25 includes legs 272 on the bottom and recessed areas 274 on the top for receiving legs 272 of a superjacent stackable unit. According to this sixth exemplary embodiment, the stackable units may be stacked upon one another, and may also be stacked directly onto a stacking surface, as a pallet is not required.

Legs 272 are formed on the bottom portion of the unit and extend below lower plane 278. Legs 272 extend below lower plane 278 by a height 275, to form front opening 273 along the front of the unit and between legs 272. In the exemplary embodiment shown, height 275 is chosen so that opening 273 is capable of receiving the forks of a forklift. In this manner, a forklift may be used to lift the unit from the floor or other stacking surfaces.

In an exemplary embodiment, the outer portions of legs 272 may form a continuous surface with peripheral wall 270. In the preferred embodiment, the unit may include a plurality of legs 272, at least four of which are situated in the corners of the unit. The top portion of each unit includes a corresponding number of recessed areas 274. Each recessed area 274 is adapted to receive a corresponding leg 272 which may extend down from a superjacent crate. Recessed area 274 includes a portion which is recessed below upper plane 276 by a depth which is equal to height 275 of legs 272. The respective leg/recessed area feature acts as an alignment feature and it can be seen that, in the exemplary embodiment shown, the locking feature described in conjunction with FIGS. 1, 2, 3 is not needed.

FIG. 26 shows two of the stackable units according to the sixth exemplary embodiment. stacked upon one another. It can be seen that legs 272 each become nested within a corresponding recessed region 274 of a subjacent crate, each of which is adapted to receive a leg 272 from a superjacent stacked crate.

It should be understood that the number and location of legs shown in the exemplary embodiments, may be varied in other exemplary embodiments. Is should be further understood that the legs may be used in conjunction with the other described embodiments.

vii. Exemplary Embodiment of Stackable Unit Formed of Components

Figure 19:
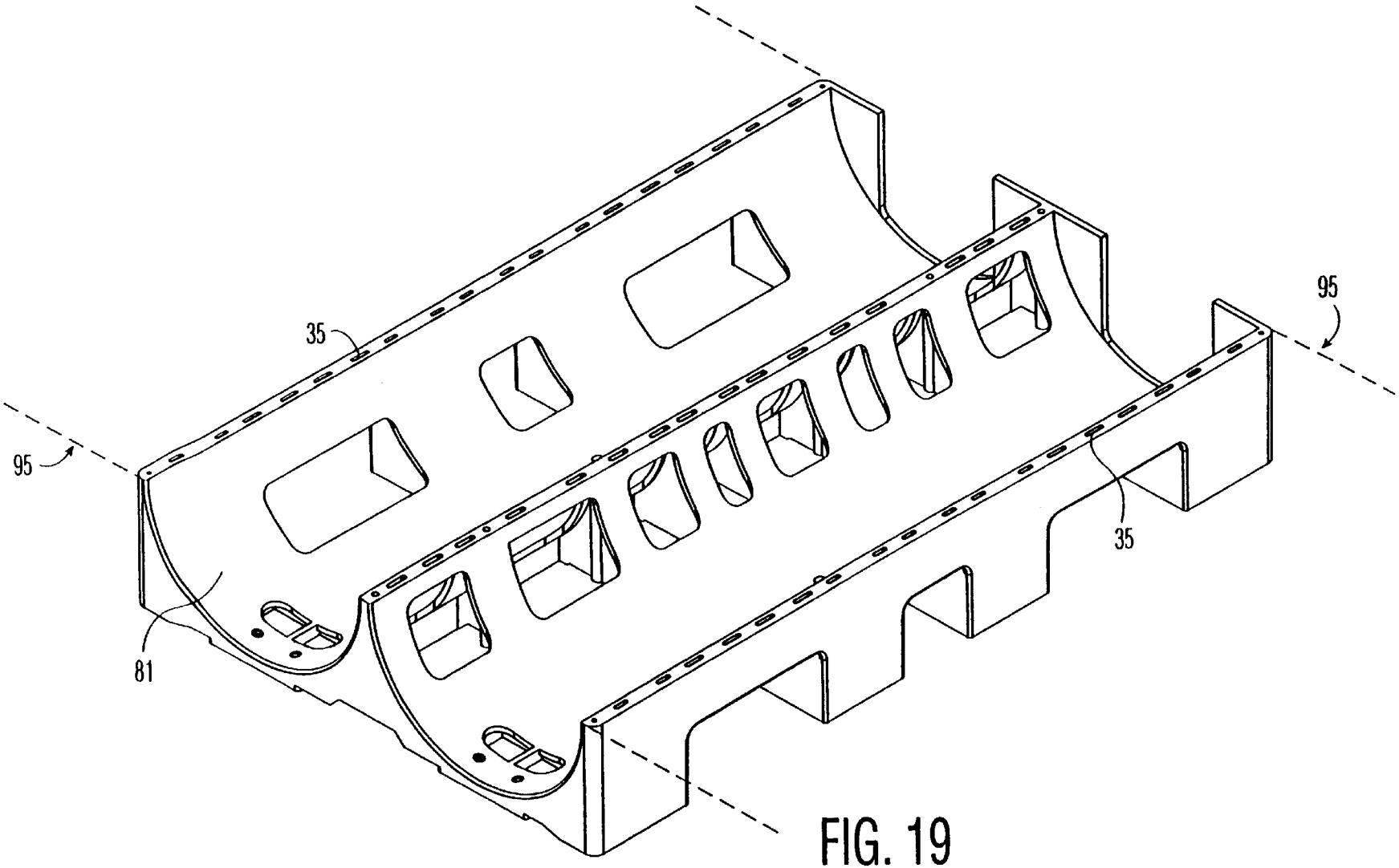
FIG. 19 is a perspective view of the lower portion of a unit molded as two separate pieces.

In another embodiment, the stackable crate unit may be constructed as two separately formed components capable of being fastened together to form a stackable crate unit. FIG. 19 is a perspective view of the lower component of a stackable crate molded as two separate units which are adapted to fasten together. Each component contains at least one U-shaped retaining member 81. In the exemplary embodiment of FIG. 19, there are two U-shaped retaining members 81.

The components are molded so that when one of the components is stacked on top of another upside-down component, with the open sections of the U-shaped members facing each other, the two components combine to form a stackable crate with a corresponding number of hollow retaining members for retaining bottles within, similar to the crate depicted in the previous figures. Openings 35 may extend through the component to receive fastening members projecting through both components, to fasten the components together, or other internal or external fastening means may be used, such as snaps. As an alternative to the openings 35, the open surface 95, may include cylindrical orifices extending from the open surface 95, into the component. These cylindrical orifices may be capable of receiving a rod, such that each rod extends into corresponding orifices from the open surfaces of each of two components stacked on top of one another (with open surfaces facing each other) to form a complete stackable crate unit. The rods may have knurled ends to aid in securing the components tightly together. The rods may be inserted into the components while the components are still hot after molding, as an alternative means of securely fastening the units together. According to other exemplary embodiments, other means for securing the two components together may be used.

The stackable crate constructed as two separate units, may also include the alignment rib set discussed with reference to FIGS. 1, 1A, 2 and 4. In a preferred embodiment, the corners along one side of the unit may include raised ribs similar to rib 13 in FIG. 1A, and corners on the opposed side of the same plane may include recessed ribs similar to recessed ribs 26 as depicted in FIG. 2. In this manner, the two separate pieces molded to combine to form one stackable crate unit, may be identical. When the stackable two-piece crate is assembled, the two sets of alignment ribs from an upper stacked crate will mate with two opposed sets of alignment ribs from a subjacent crate to align the units on top of one another, provide strength points, and lock the units into position. In an alternative embodiment, less than four alignment ribs may be used.

This feature whereby different embodiments of the two alignment ribs are used in the same (upper or lower) plane to mate with the opposite alignment rib of the opposed plane of a stacked crate, is also applicable to the unit constructed as one complete unit. Likewise, in an alternative embodiment, the stackable crate unit formed as one piece, may also use less than four alignment ribs per plane.

In other embodiments, the stackable crate units may be formed of two or more unequal pieces which are formed separately then fastened together to form a single stackable unit. Conventional fastening means, including means described above in conjunction with the two separate components described in conjunction with FIG. 19, may be used to fasten the separately formed pieces together. According to another embodiment, either of the previously described embodiments of a single stackable unit, may be formed of two or more individually formed components which are fastened together to form a single stackable unit.

The foregoing represents a detailed description of a 2×2 exemplary embodiment of the present invention. It may be understood that the units may be dimensioned and configured differently. The number of hollow retaining members may be more or less than the two illustrated in the drawings, and the crates may be sized to hold more or less than the two bottles held along the same axis within each retaining member, as depicted in the drawings of the exemplary embodiment. For example, the stackable unit may include three or four retaining members. The stackable units which include three or four laterally arranged horizontal-retaining members will also include features as described in conjunction with the previously described embodiments.

Figure 27:
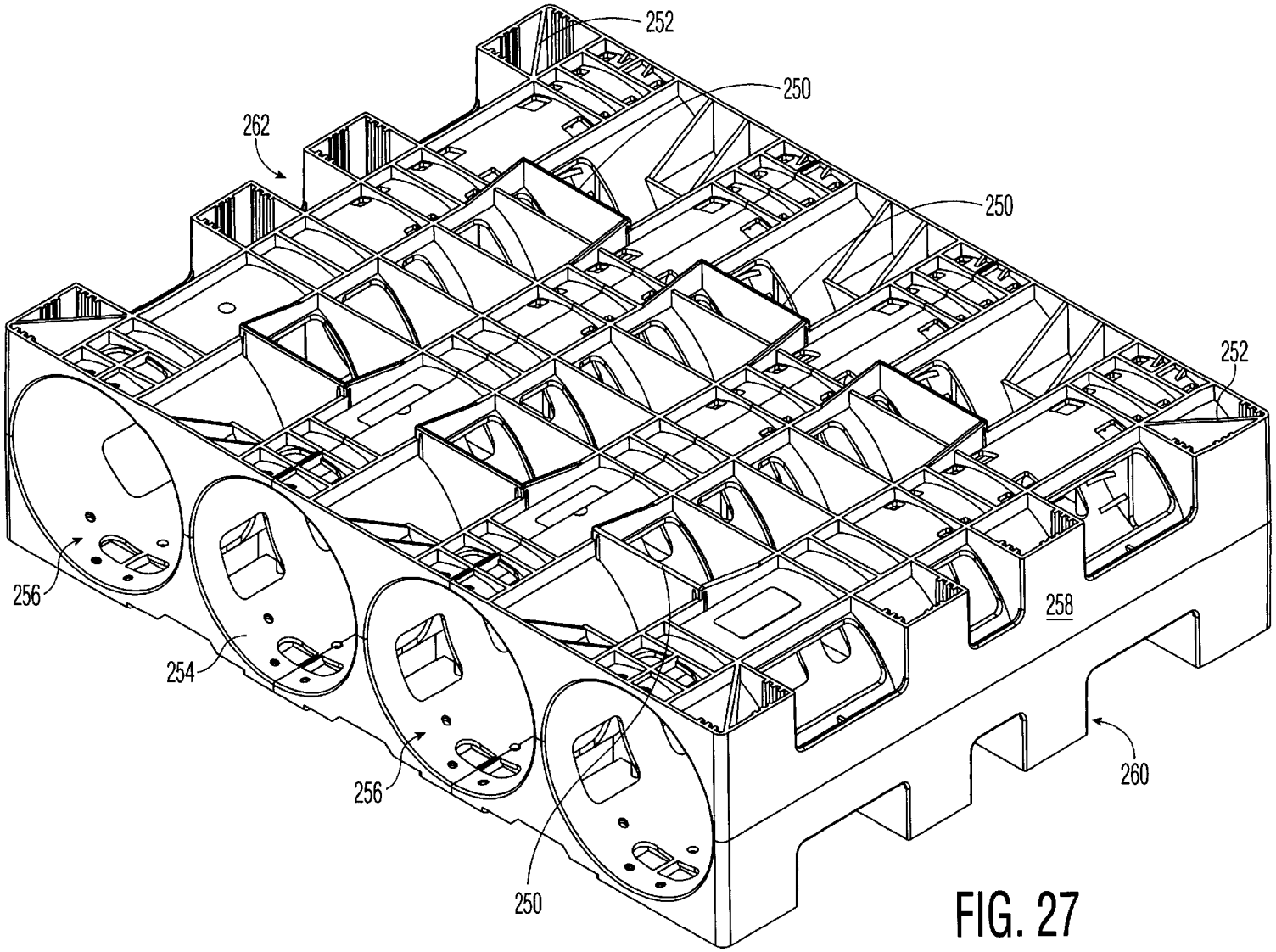
FIG. 27 is a perspective view of a sixth exemplary embodiment of a single unit in the rack system of this invention.

FIG. 27 is an exemplary embodiment of a stackable unit including a four-across configuration of hollow retaining members. In the exemplary embodiment shown in FIG. 27, raised portions 250 are located in the region between hollow retaining members 256. The four-across embodiment also includes flat alignment ribs 252 located in the corners. Raised portions 250 serve as locking features similar to raised portions 11, shown in FIG. 1 and described in conjunction with FIGS. 1 and 2. Alignment ribs 252 are also as previously described. Also in the four-across embodiment, it can be seen that the exemplary embodiment includes both retaining walls 254 within the hollow-retaining member 256, and a peripheral wall 258 extending along sides 260, and 262. It should be understood that in alternative embodiments of the four-across embodiment, the retaining wall 254 may not be needed, and the peripheral wall 258 may not be used. Rather, the sides 260 and 262 may be formed of vertical planes as previously described, and hollow-retaining member 256 may alternatively include an inner boundary formed of a discontinuous surface defined by supporting ribs also as previously described.

From the foregoing detailed description, it will be evident that there are a number of other changes, adaptations, and modifications of the present invention which come within the province of one skilled in the art. However, it is considered that all such variations not departing from the spirit of the invention, will be considered as within the scope of the present invention, which will be understood to be limited solely by the scope of the claims appended hereto.

What is claimed:

1. A stackable crate, comprising:

a top portion defining an upper plane having four corners;

a bottom portion defining a lower plane having four corners;

two opposite end portions forming a front and a rear, said front and said rear being separated by a distance defining a length;

two opposite side portions; and at least one hollow retaining member for holding at least one bottle, said member including a retaining wall having an inner surface, an outer surface and including a plurality of supporting beams connected to said outer surface of said retaining wall, each of said beams extending to at least one of said top portion and said bottom portion, and a front opening formed on said front of said crate;

wherein each retaining member is positioned to retain said at least one bottle in a horizontal orientation.

2. A stackable crate as in claim 1, wherein a pair of vertical planes forms said two opposite side portions, each vertical plane defined by a plurality of edges of vertical support ribs, said edges adjoining said vertical plane and said vertical support ribs extending inwardly.

3. A stackable crate as in claim 1, wherein said crate is a two-piece crate comprising an upper part and a lower part and wherein said upper part includes said top portion and said lower part includes said bottom portion, said upper part and lower part being separate components which are secured together.

4. A stackable crate as in claim 1, wherein said crate is formed of a plurality of separate components which are secured together.

5. A stackable crate as in claim 1, wherein each hollow retaining member defines a cylindrical cavity sized to receive two of said bottles arranged end to end.

6. A stackable crate as in claim 5, wherein said inner surface of said retaining wall includes a plurality of bores for receiving bumper pins, said bores being located along a lowermost portion of said retaining member and including at least one bore adjacent said front opening for securing a front portion of a front bottle, at least one bore situated for securing a rear portion of said front bottle, and at least one bore situated for securing a front portion of a rear bottle.

7. A stackable crate as in claim 6, further comprising bumper pins secured within said bores for retaining bottles within said retaining member.

8. A stackable crate as in claim 1, further comprising a peripheral wall generally extending from said upper plane to said lower plane and having a plurality of vertical support ribs protruding inwardly from and extending along said peripheral wall.

9. A stackable crate as in claim 8, wherein said cylindrical cavities are three in number and are disposed laterally in said crate.

10. A stackable crate as in claim 8, wherein said cylindrical cavities are four in number and are disposed laterally in said crate.

11. A stackable crate as in claim 8, wherein each hollow retaining member defines a cylindrical cavity circumferentially sized to receive standard sized three gallon bottles used in the bottled water industry and to allow for insertion and extraction of said bottles.

12. A stackable crate as in claim 8, further comprising a plurality of legs extending down from said bottom portion and below said lower plane.

13. A stackable crate as in claim 12, wherein said plurality of legs are sized and spaced to receive a forklift under said lower plane.

14. A stackable crate as in claim 12 further comprising a plurality of recessed regions disposed within said top portion and recessed below said upper plane, each recessed region adapted to receive a corresponding leg of said plurality of legs.

15. A stackable crate, comprising:

a top portion defining an upper plane having four corners;

a bottom portion defining a lower plane having four corners;

two opposite end portions forming a front and a rear, said front and said rear being separated by a distance defining a length;

two opposite side portions;

at least one hollow retaining member for holding at least one bottle, said member including an inner boundary formed of a discontinuous surface defined by edges of a plurality of supporting beams, each of said beams extending to at least one of said top portion and said bottom portion, and a front opening formed on said front of said crate; and a peripheral wall generally extending from said upper plane to said lower plane and having a plurality of vertical support ribs protruding inwardly from and extending along said peripheral wall;

wherein each retaining member is positioned to retain said at least one bottle in a horizontal orientation.

16. A stackable crate as in claim 15, wherein said plurality of supporting beams includes beams extending generally along a longitudinal direction and beams extending generally along a lateral direction.

17. A stackable crate as in claim 16, wherein said hollow retaining member is adapted to allow said at least one bottle to slide along at least one of said supporting beams extending generally along said longitudinal direction.

18. A stackable crate as in claim 15, wherein each said hollow retaining member defines a cylindrical cavity.

19. A stackable crate as in claim 15, wherein said crate is a two-piece crate comprising an upper part and a lower part and wherein said upper part includes said top portion and said lower part includes said bottom portion, said upper part and lower part being separate components which are secured together.

20. A stackable crate as in claim 15, wherein said crate is formed of a plurality of separate components which are secured together.

21. A stackable as in claim 15, further comprising a plurality of legs extending down from said bottom portion and below said lower plane.

22. A stackable crate as in claim 21, further comprising a plurality of recessed regions disposed within said top portion and recessed below said upper plane, each recessed region adapted to receive a corresponding leg of said plurality of legs.

23. A modular rack system comprising a plurality of stacked crates, each of said crates comprising:

a top portion defining an upper plane having four corners;

a bottom portion defining a lower plane having four corners;

two opposite end portions forming a front and a rear, said front and said rear being separated by a distance defining a length;

two opposite side portions;

at least one hollow retaining member for holding at least one bottle, said member including a retaining wall having an inner surface, an outer surface and including a plurality of supporting beams connected to said outer surface or to said retaining wall, each of said beams extending to at least one of said top portion and said bottom portion, a front opening formed on said front of said crate; and a peripheral wall generally extending from said upper plane to said lower plane and having a plurality of vertical support ribs protruding inwardly from and extending along said peripheral wall;

wherein said at least one hollow retaining member is positioned to retain said at least one bottle in a horizontal orientation and along a common axis; and external fastening means to releasably secure said stacked crates together.

24. A stackable crate component comprising:

a top portion defining an upper plane having four corners;

a bottom portion defining a lower plane having four corners;

two opposite end portions forming a front and a rear, said front and said rear separated by a distance defining a length;

two opposite side portions;

at least one horizontal cavity member extending from said front to said rear, said cavity member including a retaining wall having an inner surface, an outer surface and including a plurality of supporting beams connected to said outer surface of said retaining wall, each of said beams extending to at least one of said top portion and said bottom portion, and a front opening formed on said front of said crate; and a peripheral wall generally extending from said upper plane to said lower plane and having a plurality of vertical support ribs protruding inwardly from and extending along said peripheral wall;

wherein said at least one horizontal cavity member includes an open section which extends to said bottom portion, and wherein said crate component is configured to be secured to a further crate component, the combination of said crate component and said further crate component forming a stackable crate, said stackable crate including at least one enclosed horizontal retaining member.

25. A stackable crate, comprising:

a top portion defining an upper plane having four corners;

a bottom portion defining a lower plane having four corners;

two opposite end portions forming a front and a rear, said front and said rear being separated by a distance defining a length;

two opposite side portions, each side portion formed of a vertical plane defined by a plurality of edges of vertical support ribs, said edges adjoining said vertical plane and said vertical support ribs extending inwardly, and at least one longitudinal support rib extending along said plurality of edges; and at least one hollow retaining member for holding at least one bottle, said member including an inner boundary formed of a discontinuous surface defined by edges of a plurality of supporting beams, each of said beams extending to at least one of said top portion and said bottom portion, and a front opening formed on said front of said crate, wherein each retaining member is positioned to retain said at least one bottle in a horizontal orientation.

26. A stackable crate as in claim 25, wherein said crate is a two-piece crate comprising an tipper part and a lower part and wherein said upper part includes said top portion and said lower part includes said bottom portion, said upper part and lower part being separate components which are secured together.

27. A stackable crate as in claim 25, wherein said crate is formed of a plurality of separate components which are secured together.

28. A stackable crate as in claim 25, further comprising a locking mechanism, including:

a set of locking ribs positioned parallel to, and extending laterally with respect to, said lower plane, said locking ribs being indented from said lower plane by a depth of indentation, to form a recessed longitudinal cavity having a cavity depth and extending between the set of locking ribs and between respective inner surfaces of the locking ribs;

a set of locking members on said top portion corresponding to said set of locking ribs each locking member including a vertical projection having:

an upper rib projecting above, and extending laterally with respect to, the upper plane at a height greater than said depth of indentation, said upper rib having a length and including an outer surface; and a pair of sloped ribs extending perpendicularly from said upper rib, said sloped ribs being directed inwardly, and positioned to urge the locking rib of an identical superjacent crate over the upper rib, when the crate and the superjacent crate are slid longitudinally with respect to one another;

a pair of recessed lateral channels included within said bottom portion, each extending laterally with respect to, and being indented above, said lower plane and adapted to allow said upper rib and said pair of sloped ribs to slide laterally therethrough;

wherein said locking members are conditioned to be nested within said recessed longitudinal cavity whereby the inner surface of each of said locking ribs is parallel to and in close proximity with an outer surface of a respective one of said locking members, and whereby each of said pair of sloped ribs is nested within the recessed longitudinal cavity when the crate is stacked on top of the subjacent crate.

* * * * *

UNITED STATES PATENT AND TRADEMARK OFFICE

CERTIFICATE OF CORRECTION

PATENT NO : 6,142,300

DATED : November 7, 2000

INVENTOR(S) : Danile Kelly et al.

It is certified that error appears in the above-identified patent and that said Letters Patent are hereby corrected as shown below:

In column 20, line 6, of the Letters Patent "tipper" should read --upper--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*